US008695914B2

(12) United States Patent
Mohr et al.

(10) Patent No.: US 8,695,914 B2
(45) Date of Patent: Apr. 15, 2014

(54) DISPOSABLE DISPENSING AND DISPLAY CARTON FOR PAPER TOWELS AND OTHER ROLLED PRODUCTS

(75) Inventors: Rebecca Catherine Mohr, Appleton, WI (US); MeeWha Lee, Appleton, WI (US); Michael Alan Hermans, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1265 days.

(21) Appl. No.: 11/027,286

(22) Filed: Dec. 30, 2004

(65) Prior Publication Data

US 2006/0201841 A1 Sep. 14, 2006

(51) Int. Cl.
*B65H 16/06* (2006.01)

(52) U.S. Cl.
USPC ..... 242/588.6

(58) Field of Classification Search
USPC ..... 242/588.4, 588.6; 206/395, 396, 397; D6/518, 521, 522, 523
See application file for complete search history.

(56) References Cited

U.S. PATENT DOCUMENTS

| | | | | |
|---|---|---|---|---|
| 1,708,725 | A * | 4/1929 | Huempfner | 118/43 |
| 2,299,736 | A | 10/1942 | Cavoto | |
| 2,603,427 | A | 7/1952 | Holmes | |
| 2,605,975 | A | 8/1952 | Page et al. | |
| 2,702,672 | A | 2/1955 | Bonsignore | |
| 2,839,255 | A | 6/1958 | Guyer | |
| 2,871,078 | A | 1/1959 | Carleo | |
| 2,876,960 | A | 3/1959 | Glaner | |
| 2,904,274 | A | 9/1959 | Hicks | |
| 2,959,368 | A | 11/1960 | Neff | |
| 2,970,686 | A | 2/1961 | Tolaas | |
| 2,990,090 | A | 6/1961 | Catlett | |
| 3,121,542 | A * | 2/1964 | Van Dyke et al. | 242/588.4 |
| 3,130,932 | A | 4/1964 | Pena | |
| 3,245,626 | A | 4/1966 | Casteel | |
| 3,246,937 | A | 4/1966 | Galbraith | |
| 3,262,620 | A | 7/1966 | Burt et al. | |
| 3,338,399 | A | 8/1967 | Burt | |
| 3,421,800 | A | 1/1969 | Brown | |
| 3,460,863 | A | 8/1969 | Schaich | |
| 3,529,877 | A | 9/1970 | Cassidy | |
| 3,667,597 | A | 6/1972 | Hollister | |
| 3,754,719 | A | 8/1973 | Choy | |

(Continued)

FOREIGN PATENT DOCUMENTS

| | | |
|---|---|---|
| EP | 0084302 A2 | 7/1983 |
| EP | 0373746 A1 | 6/1990 |

(Continued)

OTHER PUBLICATIONS

Article—*Color in mind*, Bruce Fraser, Adobe Magazine, Nov. 1996, pp. 43-48.

*Primary Examiner* — William A Rivera
(74) *Attorney, Agent, or Firm* — Dority & Manning, PA

(57) ABSTRACT

A dispensing and display carton in combination with a rolled product is disclosed. The dispensing carton and rolled product combination generally comprises a disposable dispenser that is configured to hold a roll of tissue products, such as paper towels. The dispenser may be constructed, for instance, from paperboard, plastic or any other disposable material. Of particular advantage, the dispenser may be packaged with the roll of material and may be decorated to match or complement the roll of material.

47 Claims, 30 Drawing Sheets

(56) References Cited

U.S. PATENT DOCUMENTS

| | | | | |
|---|---|---|---|---|
| 3,754,804 | A | 8/1973 | Cushman | |
| 3,809,448 | A | 5/1974 | Rakaska | |
| 3,979,019 | A | 9/1976 | Bliss | |
| 4,058,354 | A | 11/1977 | Powaska | |
| 4,098,469 | A | 7/1978 | McCarthy | |
| 4,135,678 | A | 1/1979 | Williams | |
| 4,199,078 | A | 4/1980 | Ramirez | |
| 4,273,392 | A | 6/1981 | Stinson | |
| D262,422 | S | 12/1981 | Ortiz et al. | |
| 4,314,679 | A | 2/1982 | Paul et al. | |
| 4,362,278 | A | 12/1982 | Hopkinson | |
| 4,410,221 | A | 10/1983 | Vallis et al. | |
| 4,520,968 | A | 6/1985 | Shpigelman | |
| 4,913,773 | A | 4/1990 | Knudsen et al. | |
| 5,111,985 | A | 5/1992 | Lapeyre | |
| 5,294,040 | A | 3/1994 | Cohen | |
| D361,234 | S | 8/1995 | Ball | |
| 5,570,938 | A | 11/1996 | Butler | |
| 5,743,397 | A | 4/1998 | Traver | |
| D394,572 | S * | 5/1998 | Devaney | D6/518 |
| 5,857,621 | A | 1/1999 | Poulos | |
| 5,868,335 | A | 2/1999 | Lebrun | |
| 5,887,298 | A | 3/1999 | Semidey | |
| 5,971,150 | A | 10/1999 | Anderson et al. | |
| D419,015 | S * | 1/2000 | Umemoto | D6/522 |
| 6,012,605 | A | 1/2000 | Miloscia | |
| 6,116,534 | A | 9/2000 | Morand | |
| 6,439,386 | B1 | 8/2002 | Sauer et al. | |
| 6,563,510 | B1 * | 5/2003 | Rice et al. | 345/593 |
| 6,645,616 | B1 | 11/2003 | Sammarco et al. | |
| 6,857,540 | B2 | 2/2005 | Mitchell | |
| 2002/0063136 | A1 | 5/2002 | Sauer et al. | |
| 2004/0178210 | A1 | 9/2004 | McDonald | |
| 2004/0178219 | A1 | 9/2004 | Wang et al. | |
| 2004/0211693 | A1 | 10/2004 | Dotson | |
| 2004/0245266 | A1 | 12/2004 | Mitchell et al. | |
| 2005/0098464 | A1 * | 5/2005 | Tracy | 206/395 |
| 2005/0178781 | A1 | 8/2005 | Welchel et al. | |
| 2005/0199690 | A1 | 9/2005 | Peterson | |
| 2006/0027639 | A1 | 2/2006 | Rasmussen | |
| 2006/0168914 | A1 | 8/2006 | Steeves-Kiss et al. | |
| 2006/0180488 | A1 | 8/2006 | Spivey et al. | |

FOREIGN PATENT DOCUMENTS

| | | | |
|---|---|---|---|
| EP | 0650451 | B1 | 5/1995 |
| EP | 0922422 | A1 | 6/1999 |
| EP | 1153852 | A2 | 11/2001 |
| EP | 1153852 | A3 | 11/2001 |
| EP | 1405802 | A1 | 4/2004 |
| GB | 2239650 | A | 7/1991 |
| JP | 02228924 | | 9/1990 |
| JP | 2001269285 | | 10/2001 |
| WO | WO9837794 | A1 | 9/1998 |
| WO | WO0102254 | A2 | 1/2001 |
| WO | WO0102254 | A3 | 1/2001 |

* cited by examiner

DISPOSABLE DISPENSING AND DISPLAY CARTON FOR PAPER TOWELS AND OTHER ROLLED PRODUCTS

BACKGROUND OF THE INVENTION

Disposable sheet style dispensers are well known in the art for dispensing individual folded sheet products such as facial tissues, handsheets, wet wipes, and the like. In general, disposable sheet dispensers typically include a container and a stack or clip of pre-folded, interfolded sheets disposed within the container. The dispensers may be made from various materials. For instance, disposable dispensers are typically made from paperboard, a plastic film or a rigid plastic material. Many containers are decorated with various artwork so that the containers can be openly displayed at home, at the office, in one's car, or at any other desirable location.

Although disposable dispensers are common with respect to stacked tissue products, rolled products such as paper towels, on the other hand, are typically dispensed from more permanent structures. For example, non-disposable paper towel dispensers are typically made from thermomolded plastic, wood, or from a metal. These types of dispensers may be set on a counter and generally used vertically or may be mounted onto a wall or cabinet typically for horizontal use. Many consumers do not own the above described paper towel dispensers, however, because dispensers may be too costly, they do not wish to damage their walls and cabinets and/or because they feel the dispensers present an unsightly appearance. Thus, many paper towels are not even associated with a dispenser and are stored in cabinets and pantries instead of being readily accessible.

In view of the above, a need currently exists for a disposable paper towel dispenser. In particular, a need exists for a dispenser that may be used to dispense and display a rolled product and that may be discarded after the rolled product has been exhausted. A need also exists for a dispenser for rolled products that has an aesthetic, coordinated appearance with a rolled product.

SUMMARY OF THE INVENTION

The present disclosure is generally directed to a disposable dispenser for rolled products. For instance, in one embodiment, the dispenser can be configured to dispense a spirally wound tissue product. The rolled product may be, for instance, a bath tissue, a facial tissue, a wet wipe, an industrial wiper, a bandage, a medical drape, or the like. The sheet material that is dispensed from the dispenser may comprise, for example, wetlaid webs, airlaid webs, coform webs, hydroentangled webs, meltblown webs, spunbond webs, and laminates thereof. In one particular embodiment, the dispenser of the present invention is designed to protect, dispense and display a roll of paper towels to aesthetically complement the décor of the room.

The roll of material is contained in the dispenser such that a substantial portion of the roll remains visible. The roll of material is also secured in the dispenser so that the roll can be rotated and unwound as desired. Of particular advantage, the dispenser can include a first surface that holds the roll of material in an upright and vertical arrangement and may also include a second surface which holds the roll of material in a horizontal arrangement. Thus, the roll of material may be displayed and/or dispensed from the dispenser in either manner.

In one particular embodiment, the present invention is directed to a dispensing and display carton in combination with a rolled product. The carton and rolled product combination, for instance, may include a sheet material wound about an axis into a roll of material. The sheet material may comprise, for instance, papermaking fibers and may include an outer cylindrical surface. In one embodiment, the sheet material may comprise a paper towel having a basis weight of from about 20 gsm to about 120 gsm.

The carton and rolled product combination may further include a dispenser for dispensing the roll of material. The dispenser comprises a housing having a first end and a second end. The roll of material is placed in the dispenser such that the axis of the roll substantially extends from the first end to the second end of the housing. The roll of material is configured to rotate and unwind while in the dispenser for dispensing the sheet material. In one embodiment, the housing partially encircles the outer cylindrical surface of the roll of material so as to cover from about 10% to about 85% of the outer surface, such as from about 25% to about 75% of the outer surface, such as from about 40% to about 70% of the outer surface, and in one embodiment, may cover from about 45% to about 67% of the outer surface. In this manner, a portion of the roll of material remains visible for easy access to a free end of the tissue sheet. In addition to easy access, having a portion of the roll of material remain visible also allows for the overall design of the sheet material to coordinate with the overall design of the dispenser as will be described in more detail below.

As stated above, the dispenser can be constructed to be disposable after the roll of material has become exhausted. For instance, in one embodiment, the dispenser can be made from a material comprising cellulose fibers, such as paperboard. Alternatively, the dispenser can be made from a plastic material. In one embodiment, the housing can be made from a single piece of material, such as a single blank.

The dispenser for the roll of material may have various constructions and shapes. In one embodiment, for instance, the dispenser can include at least a first side panel connected to a second side panel at an angle of from about 70° to about 110°, such as from at an angle of from about 85° to about 95°. The first and second side panels extend between the first and second ends of the dispenser and partially encircle the roll of material. In other embodiments, the dispenser may include a third side panel or may include four side panels that are all attached together at various angles.

In one particular embodiment, the dispenser may include a first side panel at an angle of about 90° to a second side panel. In this embodiment, each end of the dispenser may have a triangular shape. Thus, the dispenser has a shape of a rectangular box cut in half. In other embodiments, the above dispenser may include a third side panel connected to the first side panel and a fourth side panel connected to the second side panel that serve to further encircle the roll of material contained in the housing. The third and fourth side panels may have a width that is less than the width of the first and second side panels. Also, it should be understood that the ends may have, in addition to a triangular shape, a square shape or a circular shape.

In another embodiment of the present invention, the housing of the dispenser may have a U-shaped cross section. Thus, the housing can be constructed from three side panels connected together. The first end and the second end of the housing may have a rectangular section and an arcuate-shaped section. The arcuate-shaped section may have a radius that generally matches the radius of the roll of material. In this embodiment, each end of the dispenser is shaped to substantially cover each end of the roll of material.

The dispenser of the present invention may further include a roll holding device that is inserted into the axial central region of the roll. For instance, the device can be inserted into a hollow center on the roll of material for securing and holding the roll of material in a manner that allows the roll to rotate and unwind. In another embodiment, the roll may not include a hollow center, and may instead be a wound roll with no clearly defined hollow center. In such an embodiment, the device can still be inserted into the central region of the roll, however, such that the roll can rotate about the longitudinal axis and unwind while secured in the dispenser. The roll holding device, for example, may comprise opposing tabs located on the ends of the dispenser. The tabs may be integral with the housing. In another embodiment, the roll holding device may comprise a spindle that extends from the first end of the housing to the second end.

In one embodiment, the present invention is directed to coordinating the appearance of the roll of material with the dispenser in order to create an overall aesthetic combination. In this embodiment, the dispenser not only dispenses the rolled product but works in conjunction with the rolled product to display the product in an aesthetically pleasing manner. For example, in one embodiment, the dispenser and rolled product combination may complement the décor of a room in which the rolled product is displayed.

In one particular embodiment, for instance, the roll of material comprises a sheet material wound about an axis. The sheet material may include at least one design element that coordinates with a design element on the dispenser. The design element, for instance, may comprise a texture, a color, a graphic subject, a pattern, or a graphic style. Graphic styles may include various graphic media and executional methods, including, for instance, watercolor, photograph, pointillism, pencil drawings, highly stylized illustrations, and the like. As used herein, the term "coordinated" means that the design element on the sheet material complements, contrasts, or matches the design element on the dispenser in an aesthetically pleasing manner.

In one embodiment, when coordinating a color on the sheet material with a color on the roll of material, reference may be made to the Munsell color scale, which categorizes and compares colors on the basis of hue, value and chroma. For example, in one embodiment, a non-white color appearing on the sheet material may be within three steps or increments on the Munsell color scale of a color appearing on the dispenser in terms of any one of hue, value or chroma. For example, the color on the sheet material may be within two steps, such as within one step of the color appearing on the dispenser in terms of any one of hue, value or chroma.

In other embodiments, one or more colors appearing on the sheet material may be within three steps on the Munsell color scale of one or more colors appearing on the dispenser in terms of any one of hue, value or chroma, but also may be at least one step away on the Munsell color scale in terms of any one of hue, value or chroma. Thus, the colors appearing on the sheet material do not have to exactly match the colors appearing on the dispenser in order for the colors to complement or contrast with each other in an aesthetically pleasing manner.

In one particular embodiment, the sheet material may include various graphic subjects. A color appearing on one of the graphic subjects may then be coordinated with a background color on the dispenser. In this manner, the dispenser may further serve to highlight and display the graphic subjects appearing on the sheet material.

In some embodiments, the sheet material may include a plurality of design elements that are coordinated with a plurality of corresponding design elements on the dispenser. For example, at least two design elements, such as at least three design elements on the sheet material may be coordinated with corresponding design elements on the dispenser. For instance, in one embodiment, a color and at least one of a graphic subject, a texture or a graphic style appearing on the sheet material is coordinated with a color and at least one of a graphic subject, a texture or a graphic style on the dispenser.

Ultimately, the overall design of the design elements on the sheet material may be coordinated with the overall design of the design elements on the dispenser. The coordination of the design elements on the sheet material with the design elements on the dispenser may be panel tested as is described in further detail below.

In addition to the above, the dispenser and roll of material combination may include other features and advantages. For instance, in one embodiment, the dispenser can be made from a single blank that is folded into the dispenser without the use of an adhesive material. If the dispenser is made from a paperboard product, the paperboard may be coated with a water resistant coating to protect the dispenser during use. In one embodiment, the dispenser may also include a gripping element, such as a handle that may be grasped by a user when removing a tissue sheet from the roll of material or when transporting the roll.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 19C is a perspective view of a dispenser made from the blank illustrated in FIG. 18 shown with a roll of material placed in the dispenser for mounting to a spindle;

Figure 1A:
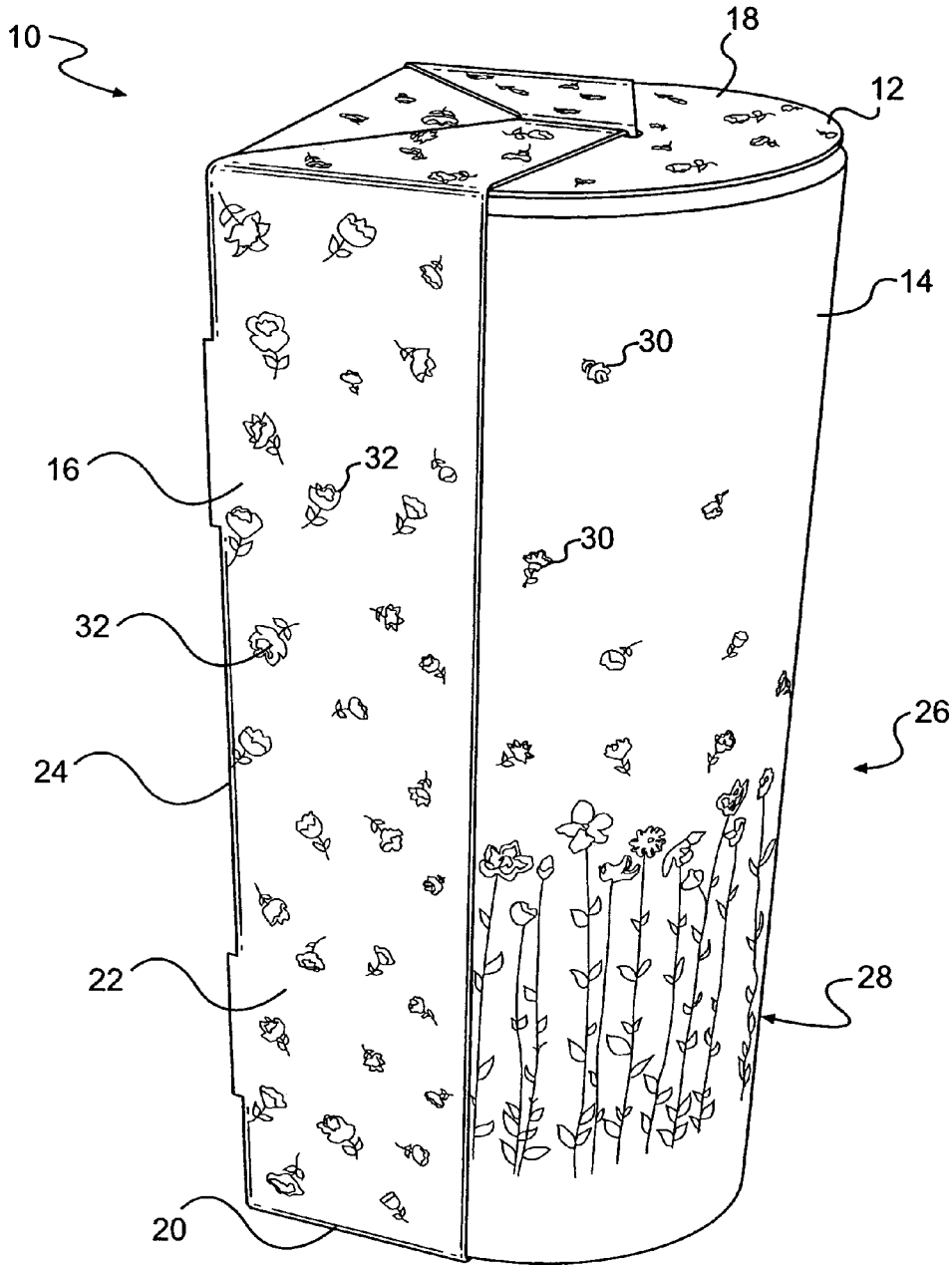
FIG. 1A is a perspective view of one embodiment of a dispensing and display carton in combination with a rolled product made in accordance with the present invention.

Repeated use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

The present disclosure is generally directed to a disposable dispenser for rolled tissue products. The tissue product may be, for instance, a bath tissue, a facial tissue, an industrial wiper, and the like. In one particular embodiment, the disposable dispenser of the present invention is well suited for use with a paper towel.

The dispenser, for instance, can be made from relatively inexpensive materials such as paperboard which refers to any semi-rigid material that is capable of being folded and contains cellulose fibers. Alternatively, the dispenser can be made from plastic materials. Of particular advantage, the dispenser may be stored, sold and displayed in combination with the rolled product, without requiring the consumer to install the product in the dispenser. For example, in one embodiment, a roll of paper towels may be rotatably mounted within the dispenser and the dispenser and towel combination may be wrapped in a clear polymer film for sale to consumers. Another advantage of the present invention is that design elements on the rolled product may be coordinated with design elements on the dispenser for providing an overall pleasing appearance. Thus, in addition to dispensing the rolled product, the dispenser can serve to display the rolled product in one's home or office by matching or complementing the décor of the room.

A dispenser made in accordance with the present invention may be used to display and dispense a rolled product either in a vertical or upright position or in a horizontal position according to the user's preference. The disposable dispenser offers many aesthetic opportunities to coordinate design elements, such as color, on the rolled product to the dispenser as well as matching other disposable dispensers such as facial tissue boxes and napkin holders. When used to hold a paper towel, the dispenser, due to being portable, can be placed at any suitable location throughout a house or office while presenting an aesthetically pleasing appearance.

Referring to FIG. 1A, for instance, one embodiment of a dispensing and display carton in combination with a rolled product generally 10 is shown. As illustrated, the carton and product combination 10 includes a roll of material 14 which, in this embodiment, is a roll of paper towels and a dispenser 12. The roll of material 14 is rotatably secured within the dispenser 12.

As shown, the dispenser 12 includes a housing 16 that includes a first end 18 and an opposite end 20. The housing also includes a plurality of side panels that partially encircle the roll of material 14. In this particular embodiment, for instance, the housing 16 includes a first side panel 22, a second side panel 24, and a third side panel (not shown) that is opposite to and matches the first side panel 22. Thus, in this embodiment, the side panels form a U-shaped cross section. The side panels generally extend from the first end 18 to the second end 20.

The housing 16 further includes an access opening 26. The access opening 26 not only allows the user to easily access a free end of the paper towels but also serves to display the roll of material 14. In general, the side panels of the housing 16 encircle the outer cylindrical surface of the roll of material 14 so as to cover from about 10% to about 85% of the outer surface of the roll, such as from about 25% to about 75% of the outer surface of the roll, such as from about 40% to about 70% of the outer surface. In one particular embodiment, for instance, the dispenser may encircle the roll of material so as to cover from about 45% to about 67% of the outer surface area of the roll of material. In the embodiment illustrated in FIG. 1A, the dispenser covers approximately 50% of the surface area of the roll of material 14.

As illustrated in FIG. 1A, the second end 20 of the housing 16 serves as a base for holding the roll of material 14 in an upright and vertical position. Of particular advantage, however, the side panel 24 is equally well suited as a base for holding and dispensing the roll of material 14 in a horizontal position. Thus, depending upon where the roll of material is to be located, a user can decide whether or not to display the roll of material in a vertical position or in a horizontal position.

As described above, the dispenser 12 may be sold with the roll of material 14 in a single package to consumers. In one embodiment, for instance, the dispenser 12 is intended to be disposed of after the roll of material is exhausted. In this embodiment, the dispenser 12 can be made from various inexpensive and disposable materials. For example, the dispenser 12 can be made entirely from paperboard, from a plastic material, or from a combination of both. In one embodiment, the dispenser may be made from a paperboard material that is coated with a water resistant material. For instance, the paperboard may be coated with a suitable polymer that will allow the dispenser 12 to become wet without degrading. The polymer coating, for instance, may be applied to the paperboard as a film.

In one embodiment, elevating elements may be attached to the dispenser 12 on areas or panels that are intended to support the roll of material 14. For example, elevating elements may be attached to the second end 20 or to the second side panel 24. In this manner, the dispenser remains elevated above a surface to prevent water or other liquids from contacting the roll of paper towels should a liquid spill in close vicinity to the dispenser 12. The elevating elements may be placed on any suitable surface of the dispenser and may have a height of from about 0.2 cm to about 0.7 cm, such as from 0.3 cm to about 0.6 cm. The elevating elements may comprise, for instance, projections or tabs made from the same material as the dispenser and may be integral with the dispenser. Alternatively, the elevating elements may comprise tabs made from a foam or a rubber-like material that are adhered to the dispenser.

If desired, the dispenser 12 may also include a securing device for securing the dispenser to an adjacent surface or wall. For example, in one embodiment, the dispenser may include suction cups for attaching the dispenser to a smooth surface. Alternatively, a pressure sensitive adhesive may be applied to one of the sides of the dispenser for anchoring the dispenser to an adjacent surface. In still another embodiment, a side of the dispenser such as second end 20 or side panel 24 may be weighted to stabilize the dispenser during use.

As shown in FIG. 1A, one of the advantages to the dispenser of the present invention is the ability to match design elements on the roll of material 14 with design elements on the dispenser 12. The design element may be, for instance, a texture, a color, a graphic subject, a pattern, or a graphic style. Graphic styles may include various graphic media and executional methods, including, for instance, watercolor, photograph, pointillism, pencil drawings, highly stylized illustrations, and the like. In accordance with the present invention, the design elements do not have to be identical but can complement, match or contrast with each other for producing a dispenser and roll combination that present an overall aesthetic and coordinated appearance.

For example, in FIG. 1A, the roll of material 14 includes various graphic subjects, such as a row of flowering plants 28 and a plurality of flowers 30. In comparison, the dispenser 12 includes a plurality of flowers 32 that are substantially similar to the flowers 30 appearing on the roll of material 14.

Figure 1B:
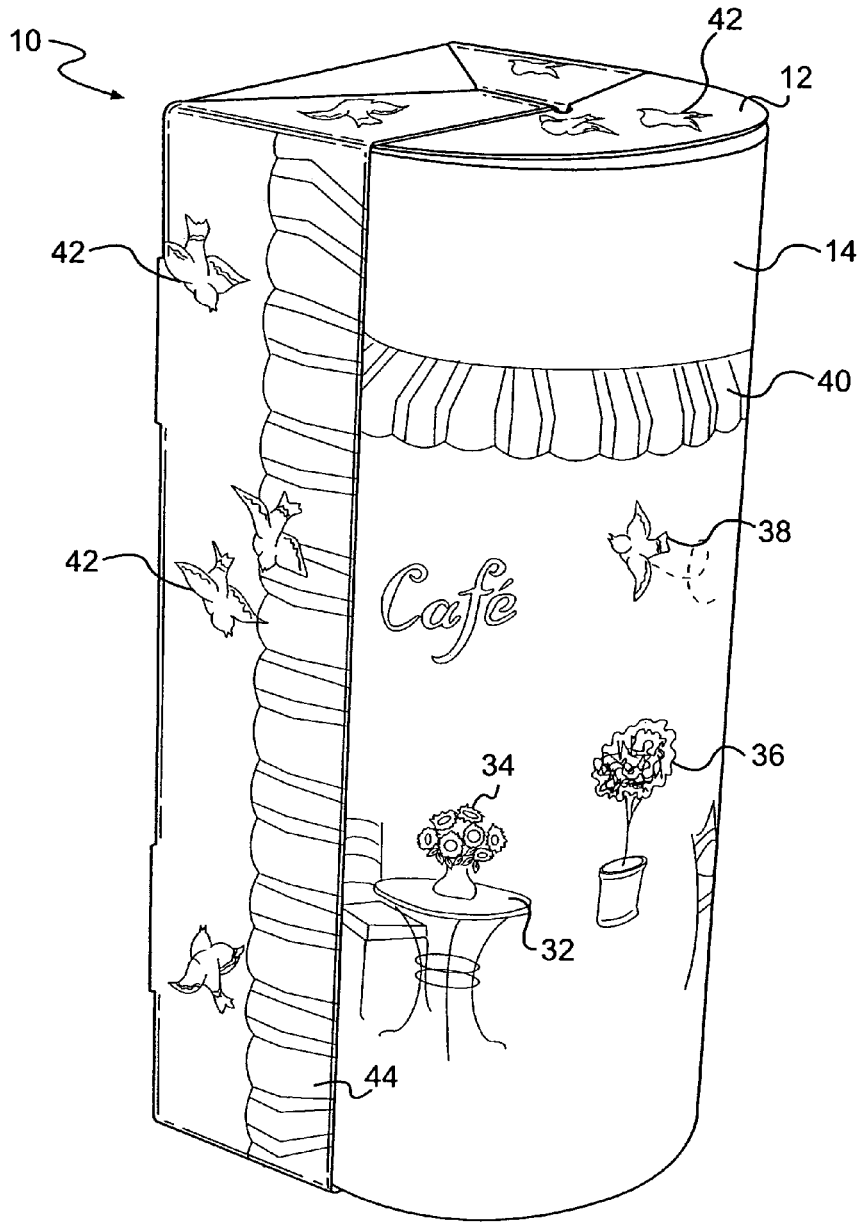
FIG. 1B is another embodiment of a dispensing and display carton in combination with a rolled product made in accordance with the present invention.

Referring to FIG. 1B, another embodiment of a dispensing and display carton in combination with a rolled product generally 10 is shown. Like reference numerals have been used to indicate similar elements. Referring to FIG. 1B, the carton 10 includes a dispenser 12 and a roll of material 14 that generally have the same construction and arrangement as the dispenser and roll of material shown in FIG. 1A. In FIG. 1B, however, the roll of material 14 depicts a "café-like" setting including a table and chairs 32, a flower arrangement 34, a plant 36, a bird flying overhead 38, and an awning 40. In order to coordinate certain of the design elements contained on the roll of material 14, the dispenser 12 includes birds 42 and an awning 44.

It should be understood that numerous design elements may be matched and combined between the dispenser and the roll of material depending upon the end use of the product and the desired overall coordination.

In addition to graphic subjects, in other embodiments, a texture appearing on the roll of material may be coordinated with a texture appearing on the dispenser. For example, various patterns and other designs may be embossed or molded into the sheet material that comprises the roll of material. These designs and patterns or a similar design and pattern may be similarly embossed or otherwise formed into the dispenser. For example, in one embodiment, the roll of material is formed from a tissue sheet. The tissue sheet may be created according to an uncreped through-air dried process in which the topography of a forming fabric is molded into the tissue sheet. For example, in one embodiment, the tissue sheet may be formed with valleys and ridges that extend in a generally parallel direction. A similar pattern of valleys and ridges can then be formed into the dispenser in order to coordinate texture between the roll of material and the dispenser.

In addition to or instead of coordinating the design elements described above, in other embodiments, one or more colors appearing on the roll of material 14 may be coordinated with one or more colors appearing on the dispenser 12. For instance, any non-white color appearing on the roll of material may be matched identically, may be complemented with or may be contrasted with a non-white color appearing on the dispenser 12.

Figure 20:
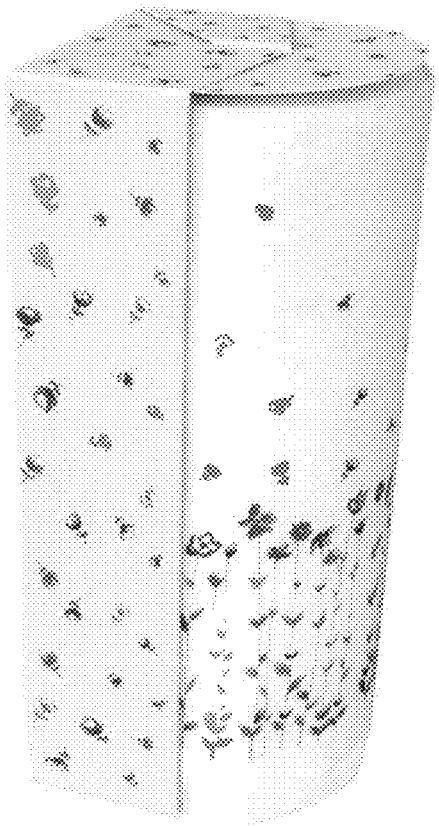
FIGS. 20, 21 and 22 are color photographs of various embodiments of rolled product and dispenser combinations illustrating design elements on the rolled product that are coordinated with design elements on the dispenser including color coordinations.
Figure 21:
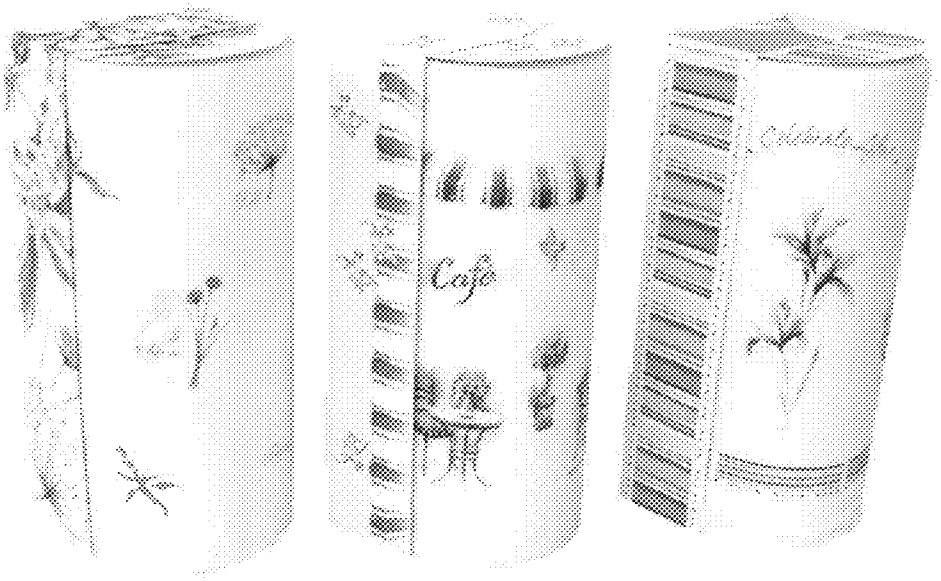
Figure 22:
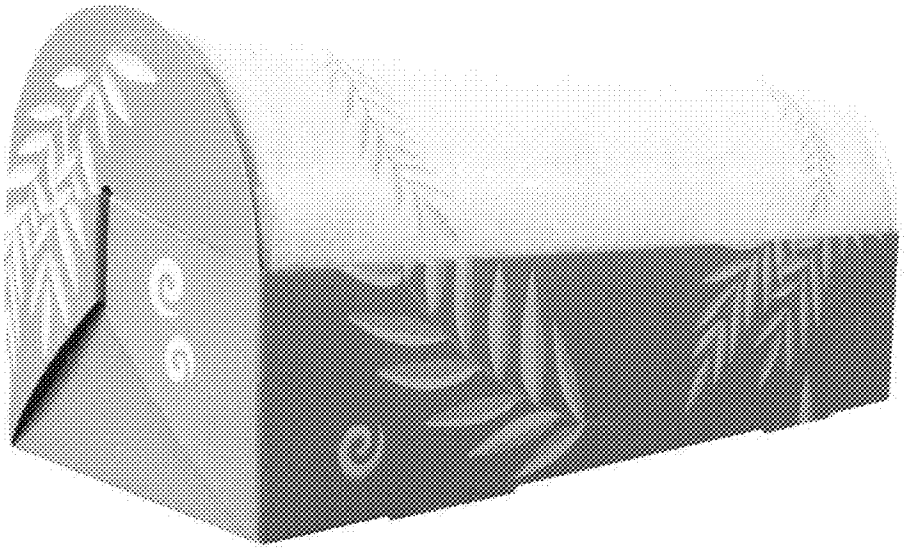

For example, referring to FIGS. 20-22, various embodiments of dispenser and rolled product combinations are illustrated that include color coordination. For instance, referring to FIG. 20, the dispenser and rolled product combination illustrated in FIG. 1A is shown in color. As illustrated, the colors on the flowers appearing on the rolled product are coordinated with the colors of the flowers appearing on the dispenser. In this embodiment, the dispenser includes a light blue background color which further serves to complement and accentuate the design elements appearing on the roll of material.

In FIG. 21, three further examples of rolled product and dispenser combinations in accordance with the present invention are illustrated. The middle embodiment appearing in FIG. 21 comprises a color version of the embodiment illustrated in FIG. 1B. As shown, not only do certain colors on the rolled product match certain colors on the dispenser, but the dispenser also includes a light blue background that further complements the dark blue colors of the rolled product.

In the embodiment shown on the left in FIG. 21, plants or herbs appearing on the rolled product are coordinated with the graphic subjects appearing on the dispenser. As shown, the size of the graphic subjects appearing on the dispenser are enlarged with respect to the size of the graphic subjects appearing on the rolled product. In other embodiments, it should be understood that the graphic elements appearing on the dispenser may be the same size, larger or smaller than the graphic elements appearing on the rolled product depending upon the desired result.

Referring to the embodiment illustrated on the right in FIG. 21, the rolled product includes colorful flowers positioned over a color coordinated bar. The color coordinated bar on the roll of material is then coordinated with colors appearing on the dispenser. As shown, the pattern of the color bar on the roll of material is not identical to but coordinates with the rolls of colors appearing on the dispenser.

Referring to FIG. 22, another embodiment of a rolled product and dispenser combination is illustrated. In this embodiment, the rolled product is generally white in color and includes a design of fern leaves and a non-white color. In order to coordinate design elements, the dispenser also includes a similar enlarged fern leaf design. As also shown, the colors appearing on the roll of material are reversed with the colors appearing on the dispenser. In particular, on the dispenser the fern leaf is in an off white color, while the background color of the dispenser coordinates with the color of the fern leaves appearing on the roll of material.

As shown by the embodiments illustrated in FIGS. 20-22, the colors appearing on the roll of material may be coordinated with the colors appearing on the dispenser in numerous ways. In one particular embodiment, however, color coordinating between the roll of material and the dispenser may be accomplished using the Munsell Color-Order System. The Munsell Color-Order System is a way of precisely coordinating colors quantitatively by examining three qualities or attributes of color, namely hue, value and chroma. The Munsell Color-Order System is referenced and used, for instance, in the *Munsell Book of Color, Matte Collection; Munsell Book of Color, Nearly Neutrals Collection*; and *Munsell Book of Color, Glossy Collection*, which are published by the Munsell Color Corporation and are commercially available through GretagMacBeth and the Munsell Laboratory, and which are all incorporated herein by reference.

In the Munsell Color-Order System, hue, value and chroma may be varied independently so that all colors may be arranged according to the above three categories or attributes in a 3-dimensional relationship. This 3-dimensional relationship is referred to as the "Munsell Color Space". The neutral colors are placed along a vertical line called the "neutral axis" with white at the top of the axis, black at the bottom of the axis, and gray shades in between.

The different hues are displayed at various angles around the neutral axis. The chroma scale is perpendicular to the neutral axis and increases outwardly.

Hue is an attribute of color by which colors are distinguished from one another. The hues are arranged from red to yellow to green to blue and to purple. Under the Munsell Color-Order System, a hue color circle is divided into 100 steps or increments of equal visual change. There are 10 major hues broken down into 5 principle and 5 intermediate hues. All of the hues are given a one or two letter designation and are arranged around the color circle. The main hues are red, yellow, green, blue and purple. They are placed at equal intervals around the circle. The five intermediate hues are yellow-red, green-yellow, blue-green, purple-blue, and red-purple. Each of the 10 major hues are broken into 4 equal segments which are given the numerical prefixes 2.5, 5, 7.5 and 10. The initials of each hue are used as symbols to designate the ten hue sectors: R, YR, Y, GY, G, BG, B, PB, P and RP. The hue circle is arbitrarily divided into 100 steps or increments, with the zero point at the beginning of the red sector.

Value indicates the degree of lightness of a color in terms of a neutral gray scale. The scale ranges from 0 for black and 10 for white.

Chroma, on the other hand, is the degree of departure of a color from the neutral color scale of the same value. Chroma may be considered to measure the relative purity of a color. As a color gets more vivid, the chroma increases. Neutral colors are given a designation of 0 and there is no tangible upper limit. The scaling of chroma is visually uniform and the units are arbitrary. The chroma scale for normal color is from zero to 20. Fluorescent materials, however, have chromas as high as about 30.

The complete Munsell notation for a chromatic color is written "hue value/chroma". For instance, for a vivid red having a hue of 5R, a value of 6 and a chroma of 8, the notation is 5R 6/8.

Steps or increments on the Munsell color scale thus do not increase numerically by one. Instead, the steps or increments on the Munsell color scale may increase by less than 1 or greater than 1 and may include a letter designation when quantifying hue.

In order to coordinate colors between the roll of material 14 and the dispenser 12 as shown in FIGS. 1A and 1B, for instance, in one embodiment, a color appearing on the roll of material may be within 3 steps or increments in terms of any one of hue, value or chroma of a color appearing on the dispenser. For example, the color appearing on the roll of material may be within two steps, such as within one step on the Munsell color scale of a color appearing on the dispenser in terms of any one of hue, value or chroma. In other embodiments, one or more colors appearing on the roll of material may be coordinated with one or more colors appearing on the dispenser so that at least two of the attributes or all three of the attributes of hue, value and chroma are within three steps, such as within two steps, or within one step of each other on the Munsell color scale.

In some embodiments, it may be desirable so that one color appearing on the roll of material does not identically match a color appearing on the dispenser. For example, the color appearing on the roll of material may be at least one step, such as at least two steps away on the Munsell color scale from the color appearing on the dispenser in terms of one or all of the attributes of hue, value and chroma.

In general, any color appearing on the roll of material may be coordinated with any color appearing on the dispenser. For instance, the main or primary non-white color on the roll of material may coordinate with the main color on the dispenser or a secondary color on the roll of material may coordinate with a secondary color on the dispenser. In still other embodiments, the main or primary color on the roll of material may coordinate with a secondary color on the dispenser and vice versus.

Ultimately, through coordination with color or other design elements, the overall design appearing on a roll of material may be coordinated with the overall design appearing on the dispenser. In one embodiment, for instance, the coordination of the design elements between the roll of material and the dispenser may be "panel tested". As used herein, a "panel tested" coordination refers to a test that determines coordination when at least two-thirds of a 60 person panel find that design element coordination exists between the dispenser and a roll of material. The 60 person panel is comprised of 30 men and 30 women randomly selected. The 60 person panel, however, must include an even distribution of age from age 18 to senior citizens. Each person serving on the panel must also not be colorblind or suffer from any other eye ailment that would impair the ability to distinguish colors.

The roll of material 14 as shown in FIGS. 1A and 1B represents a paper towel roll. The paper towel, for instance, may contain papermaking fibers, such as softwood and/or hardwood pulp fibers and may have a basis weight of, for instance, from about 20 gsm to about 120 gsm, such as from about 40 gsm to about 90 gsm. In the United States, the paper towel may have a sheet width of about 11 inches and the roll as sold may have a diameter of from about 4 inches to about 8 inches, such as from about 5 inches to about 7 inches. Worldwide, the height of the roll may be from about 7 inches to about 11 inches. The height and diameter of the roll and the individual sheet size may vary from these particular dimensions. In addition, it should be understood that the dispenser of the present invention may be used in combination with other rolled products, such as facial tissues, bath tissues, industrial wipers, and the like.

Figure 2:
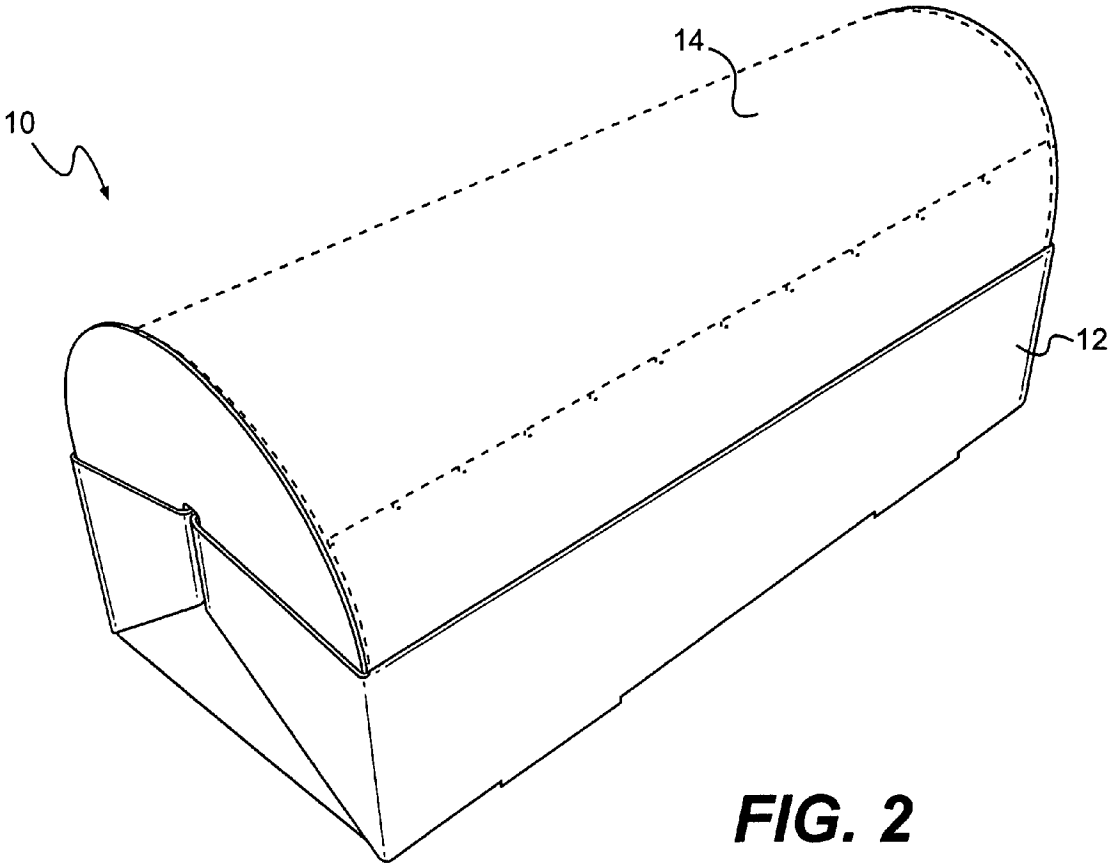
FIG. 2 is a perspective view of the dispensing and display carton in combination with a rolled product shown in FIGS. 1A and 1B, but without any graphics.
Figure 3:
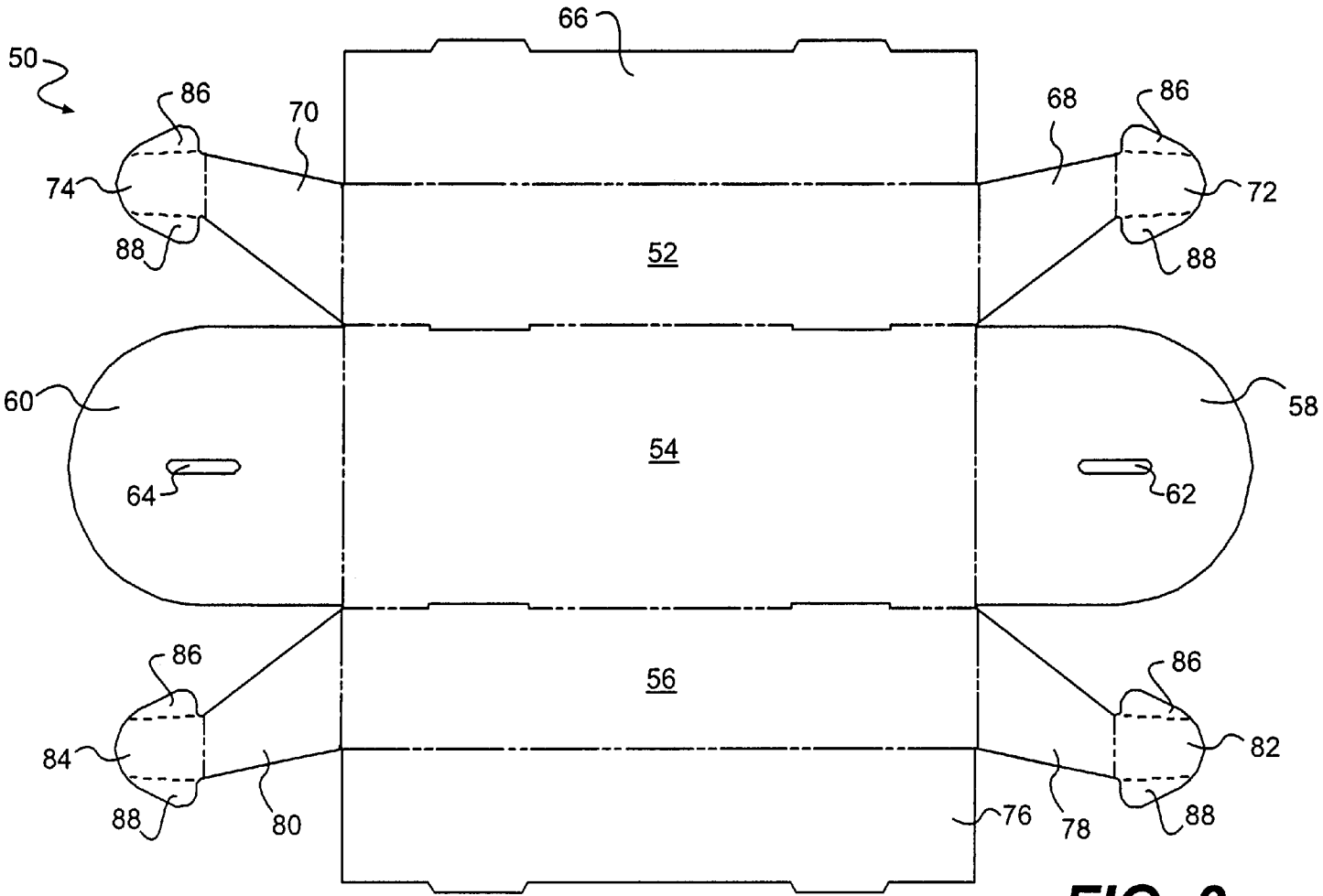
FIG. 3 is a plan view of one embodiment of a blank that may be used to construct the dispenser illustrated in FIG. 2.

Referring to FIG. 2, the dispensing and display carton and rolled product combination generally 10 is shown without any design elements and in a horizontal position. In FIG. 2, the roll of material 14 is also shown in phantom. In order to construct the dispenser 12 as shown in FIGS. 1A, 1B and 2, a single one-piece blank generally 50 as shown in FIG. 3 may be used. The blank 50 includes three side panels 52, 54 and 56. The side panel 54 is connected by a fold line to a pair of opposing end panels 58 and 60. First end panel 58 defines a first slot 62 while the second end panel 60 defines a second slot 64.

Figure 4A:
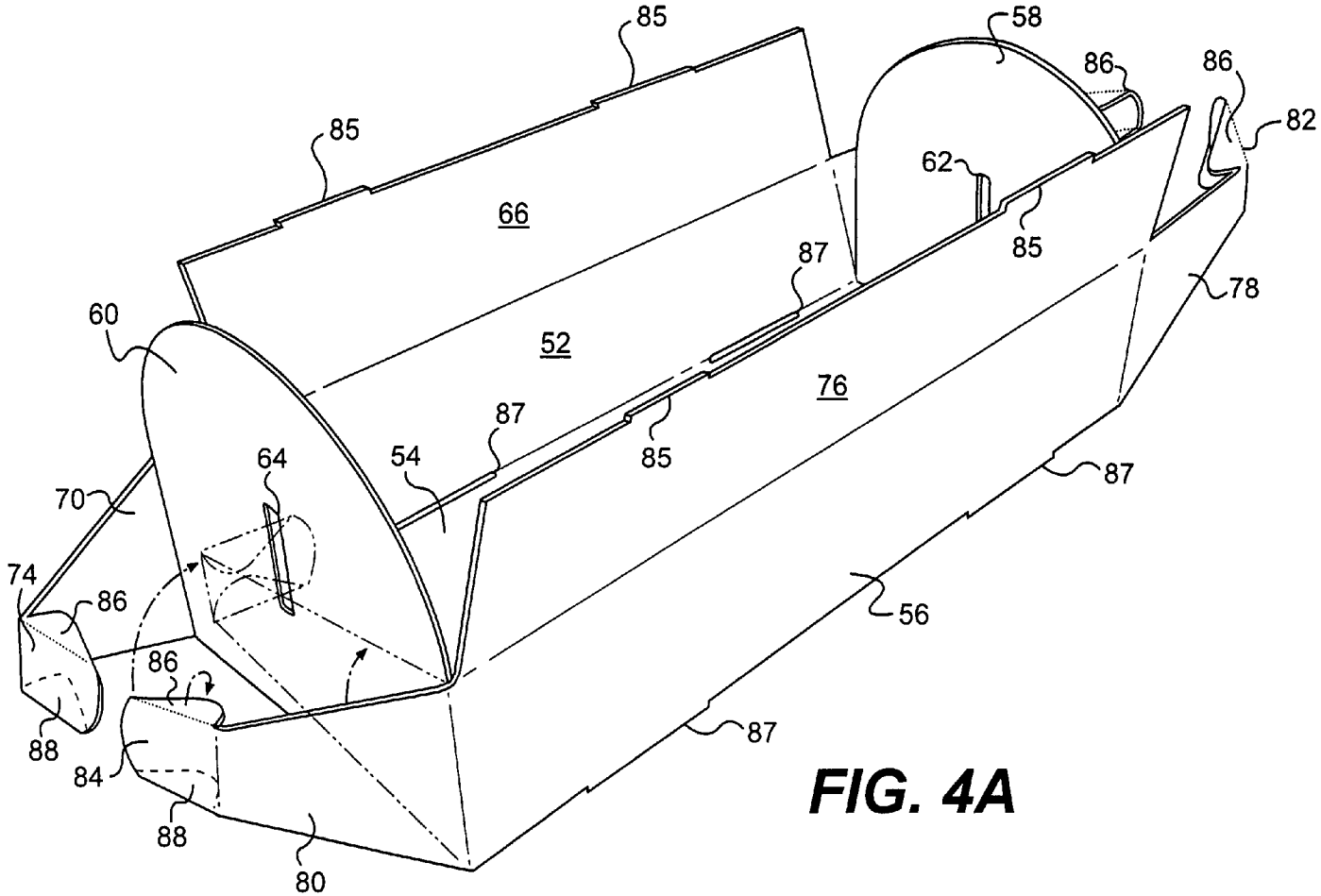
FIG. 4A is a perspective view of the blank illustrated in FIG. 3 shown in a partially folded state.
Figure 4B:
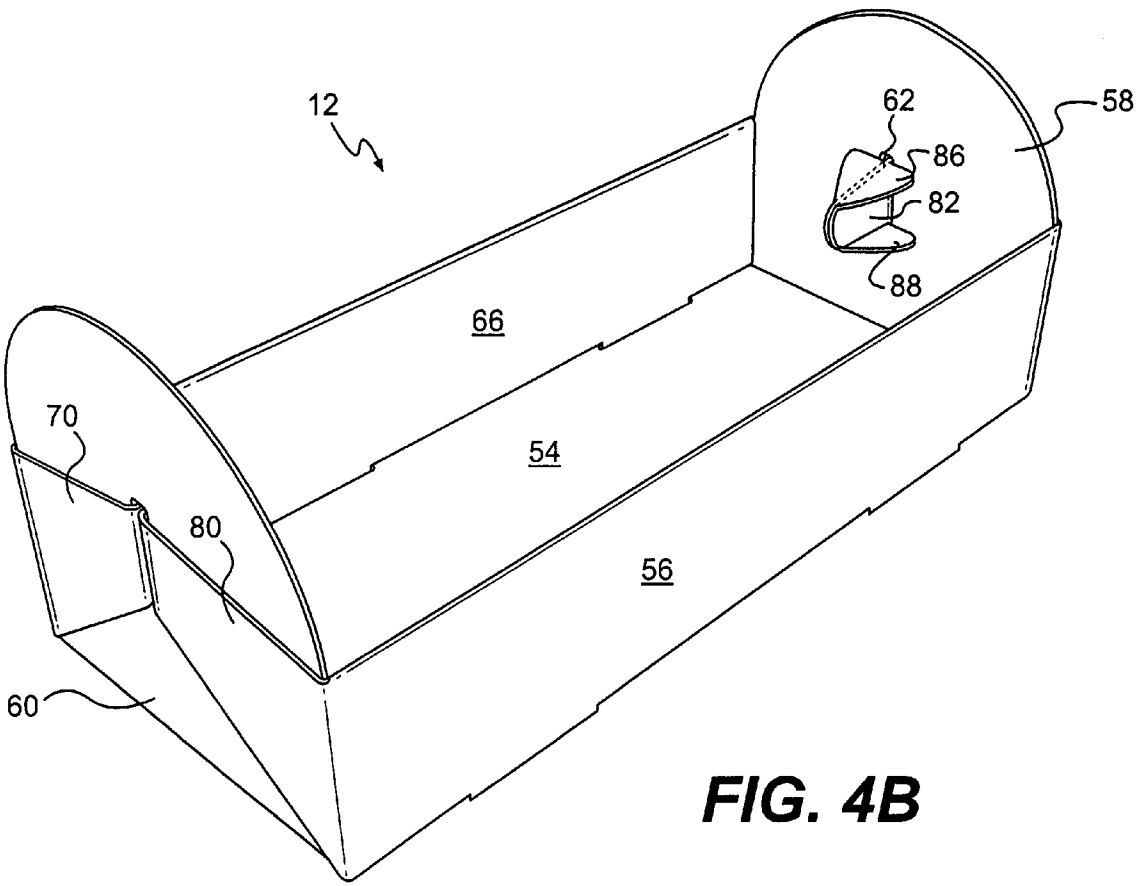
FIG. 4B is a perspective view of a dispenser made from the blank illustrated in FIG. 3.

As shown in FIG. 3, the side panel 52 is connected to a side flap 66 and to a pair of opposing end flaps 68 and 70. The end flap 68 is also connected to a tab 72, while the end flap 70 is connected to a tab 74. Similarly, the side panel 56 is connected to a side flap 76 and to a pair of opposing end flaps 78 and 80. The end flap 78 is connected to a tab 82 while the end flap 80 is connected to a tab 84. Each of the tabs 72, 74, 82 and 84 include a pair of locking elements 86 and 88. Referring to FIG. 4A, the blank 50 as shown in FIG. 3 is illustrated in a partially assembled state. In FIG. 4B, the blank 50 is shown folded into the dispenser 12 as shown in FIG. 2. Of particular advantage, the single piece blank 50 as shown in FIG. 3 may be folded into the dispenser as shown in FIG. 4B without the use of any adhesive materials or the like.

As shown in FIG. 4A, the end panels 58 and 60 are folded upwards in relation to the side panel 54. The side panels 52 and 56 are also folded in an upward relationship to the side panel 54. In this manner, the side panels 52, 54 and 56 form a U-shaped cross section.

The end flaps 68, 70, 78 and 80 are folded around the end panels 58 and 60. The tabs 74 and 84 are then inserted into the corresponding slot 64, while the tabs 72 and 82 are inserted into the slot 62. For instance, referring to FIG. 4B, the tab 82 is shown inserted into the slot 62. The locking elements 86 and 88 are folded in order to insert the tab into the slot. Once inserted, the locking elements are then folded in a 90° relationship to the tab 82 in order to lock the tabs into place. The tabs 72, 74, 82 and 84 then serve as a roll holding device that may be inserted into the central region such as the core of a roll of material. In this manner, the roll of material is rotatably secured within the dispenser 12.

In other embodiments, it should be understood that the roll of material contained within the dispenser has a coreless center. In these embodiments, the roll holding device may be any suitable device that is capable of gripping each end of the roll of material. For instance, the roll holding device may comprise relatively sharp projections that are inserted into the roll of material for rotatably securing the material within the dispenser.

As shown in FIGS. 4A and 4B, the side flaps 66 and 76 are folded over the corresponding side panels 52 and 56. Each of the side flaps 66 and 76 include projections 85 that are configured to be inserted into corresponding slots 87 for locking the side flaps into place. Once the side flaps are folded, the dispenser 12 is formed as shown in FIG. 4B.

Figure 5:
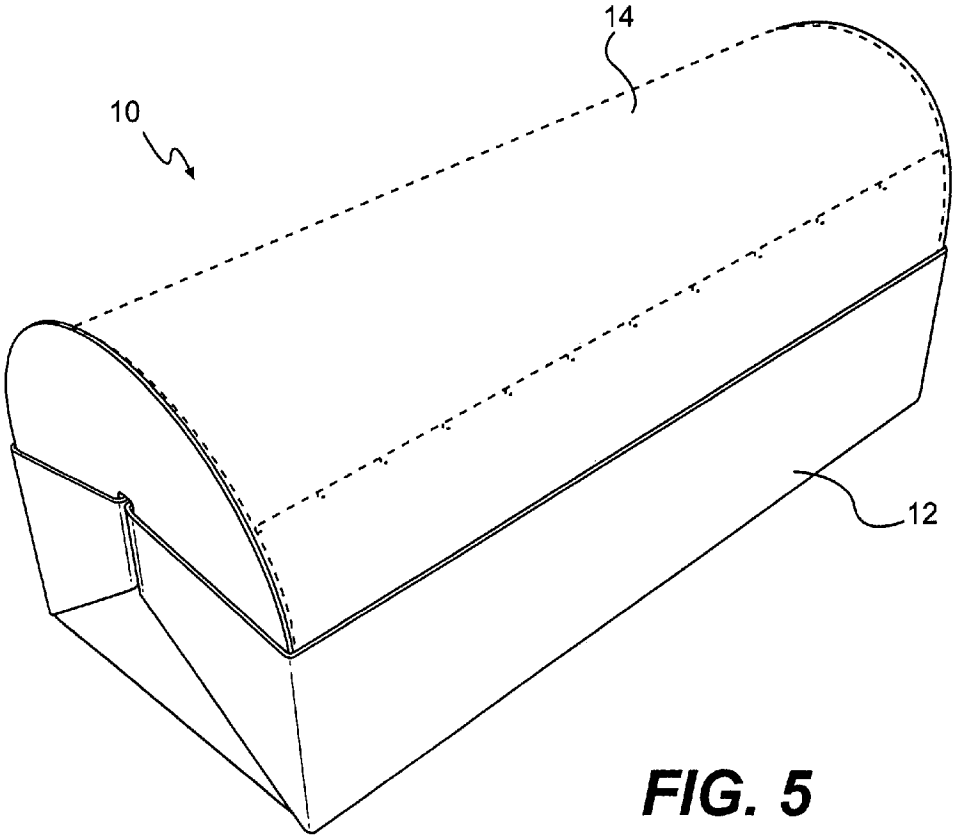
FIG. 5 is another embodiment of a dispensing and display carton in combination with a rolled product made in accordance with the present invention.

Referring to FIGS. 5, 6, 7A and 7B, another embodiment of a dispensing and display carton and rolled product combination generally 10 made in accordance with the present invention is illustrated. Like reference numerals have been used to indicate similar elements. As shown in FIG. 5, the carton and rolled product combination 10 includes a dispenser 12 for rotatably mounting a roll of material 14, such as a roll of paper towels.

Figure 6:
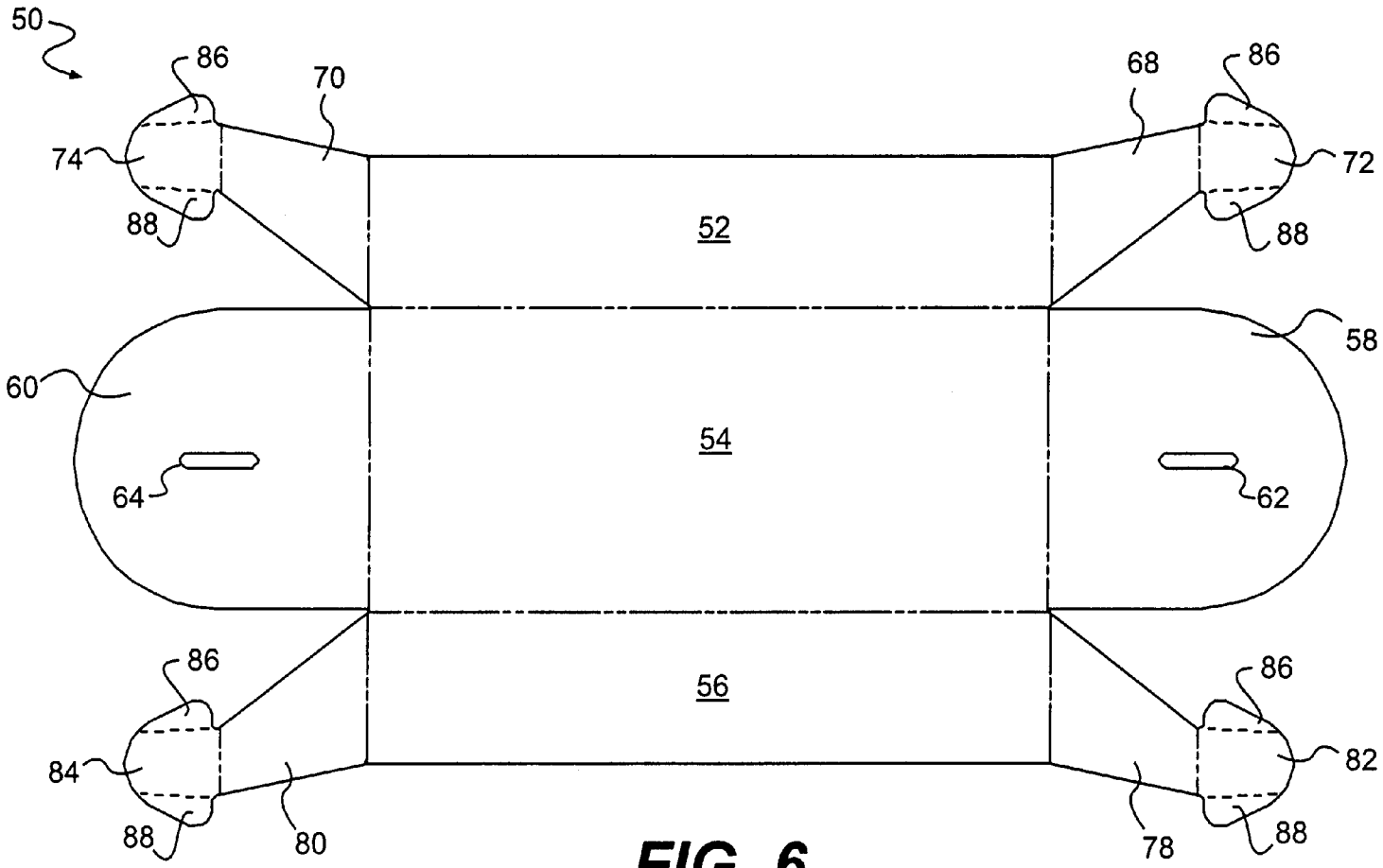
FIG. 6 is a plan view of one embodiment of a blank that may be used to construct the dispenser illustrated in FIG. 5.
Figure 7A:
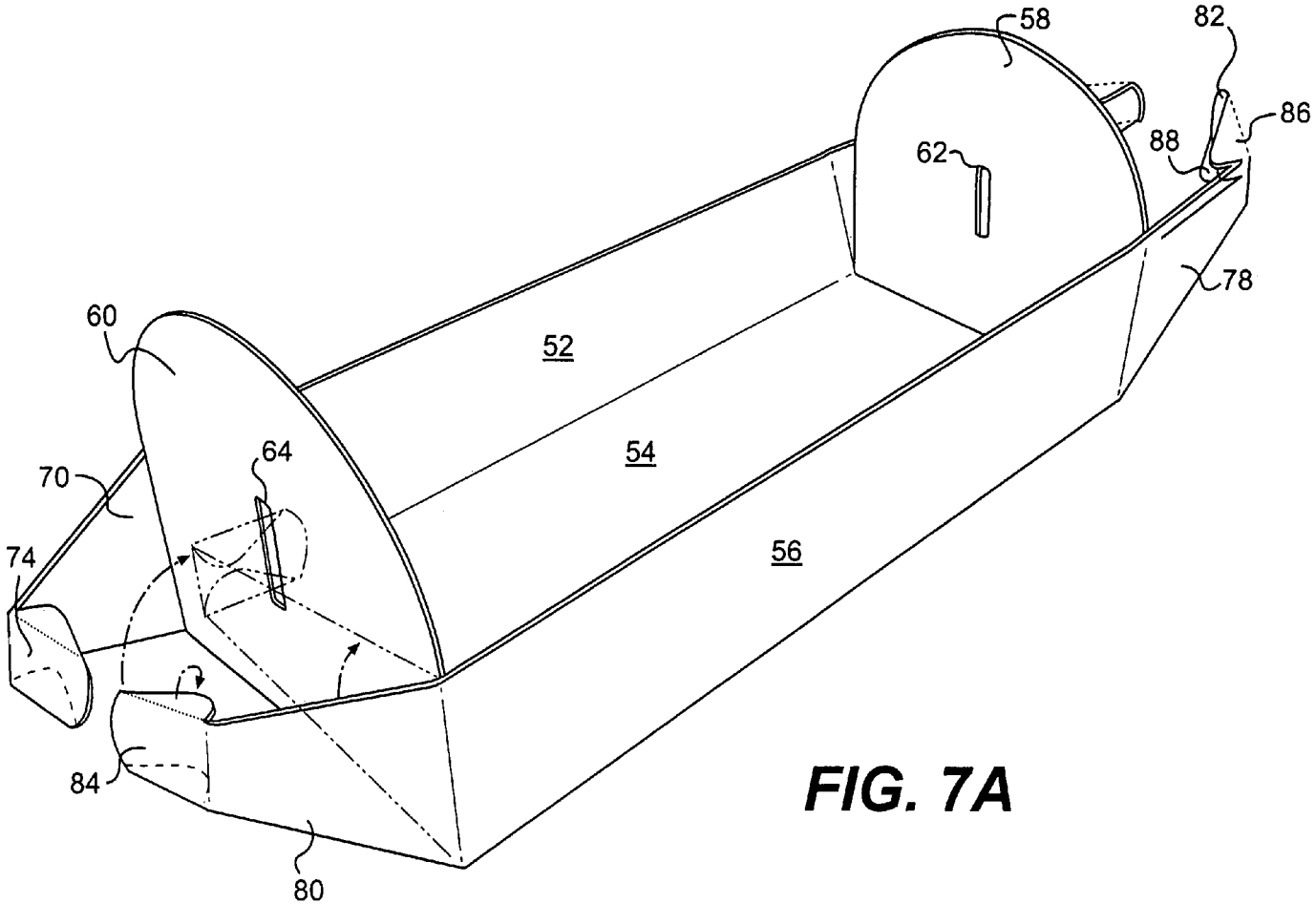
FIG. 7A is a perspective view of the blank illustrated in FIG. 6 shown in a partially folded state.
Figure 7B:
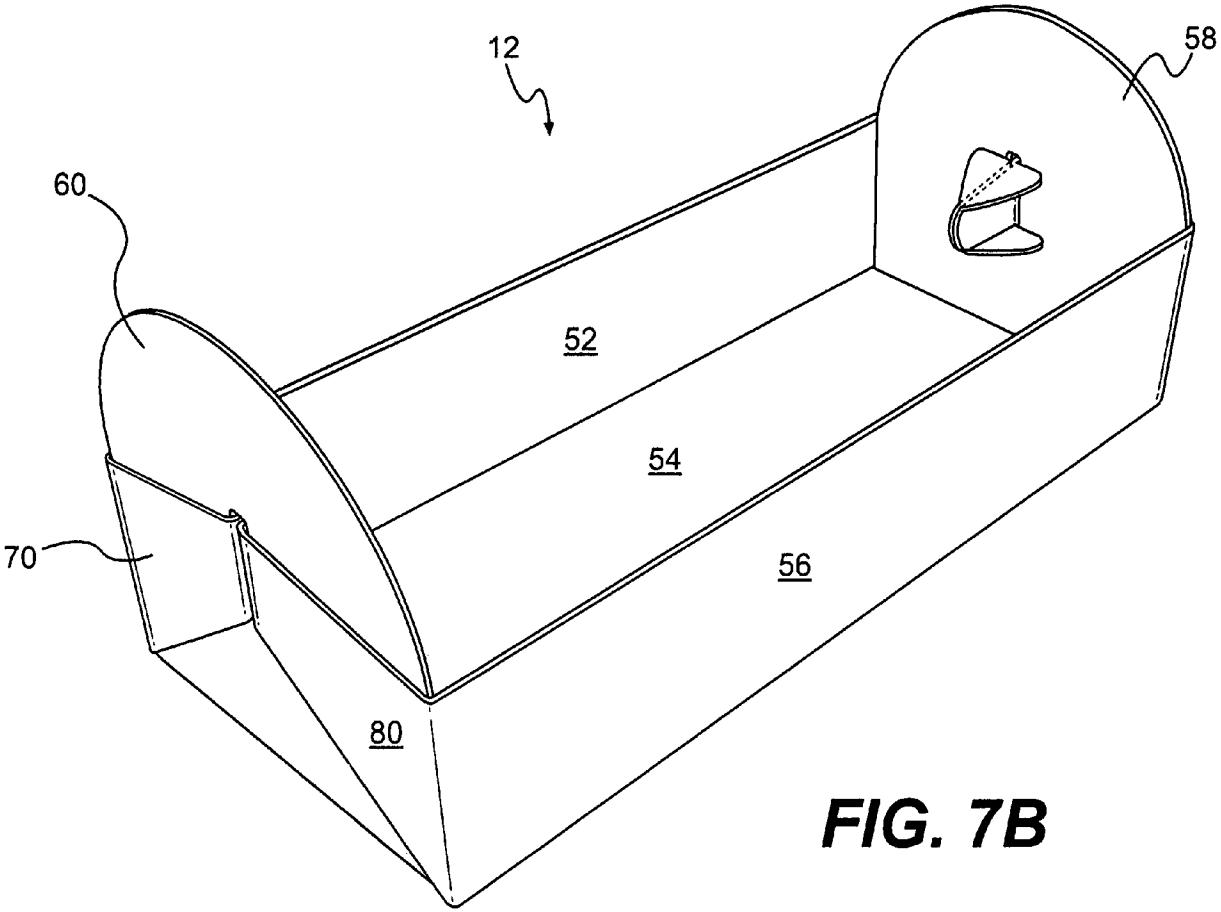
FIG. 7B is a perspective view of a dispenser made from the blank illustrated in FIG. 6.

Referring to FIGS. 6, 7A and 7B, a blank 50 is shown being folded into the dispenser 12 as shown in FIG. 5. The blank 50 as shown in FIG. 6 is similar to the blank 50 shown in FIG. 3. In this embodiment, however, the blank 50 does not include the side flaps 66 and 76 as shown in FIG. 3. Otherwise, the dispenser 12 as shown in FIG. 1B is folded and assembled similar to the dispenser illustrated in FIGS. 4A and 4B.

Figure 8:
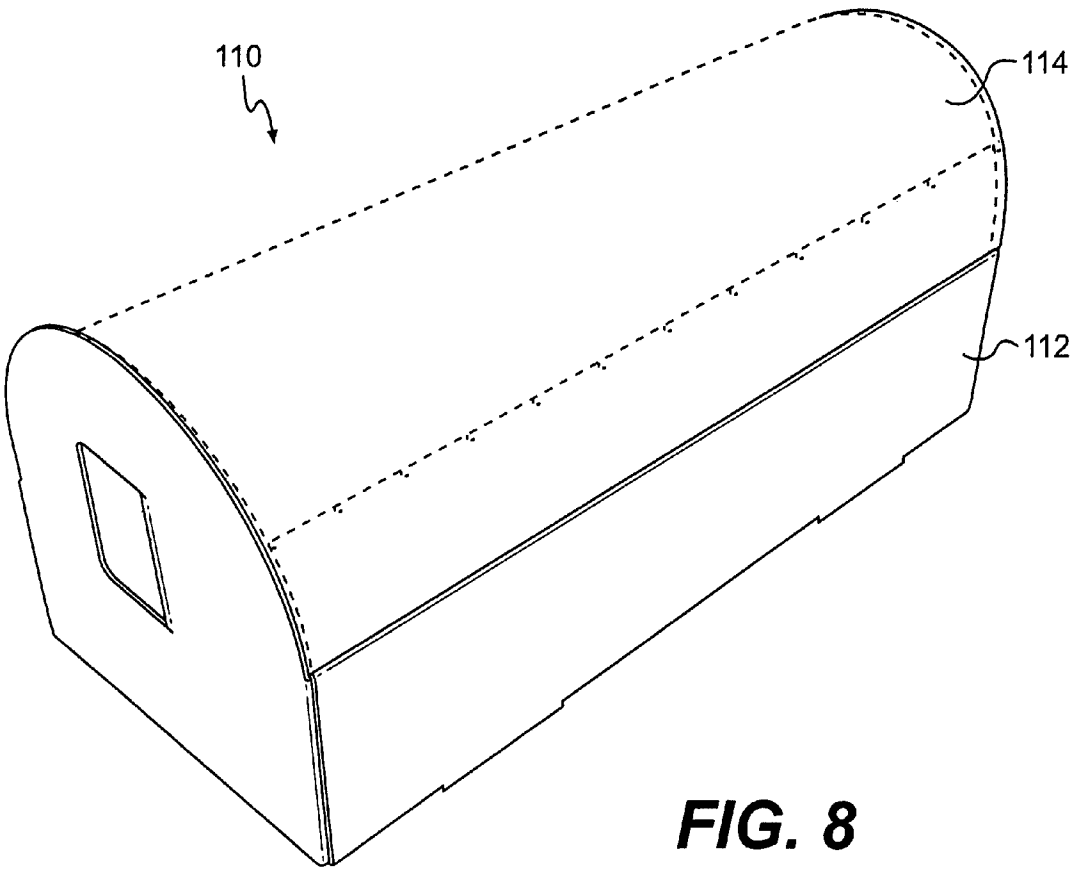
FIG. 8 is still another embodiment of a dispensing and display carton in combination with a rolled product made in accordance with the present invention.

Referring to FIG. 8, still another embodiment of a dispensing and display carton and rolled product combination generally 110 is shown. The carton and rolled product combination 110 as shown in FIG. 8 is somewhat similar in appearance to the embodiment illustrated in FIG. 5. The carton and rolled product combination 110 includes a roll of material 114 rotatably mounted within a dispenser 112.

Figure 9:
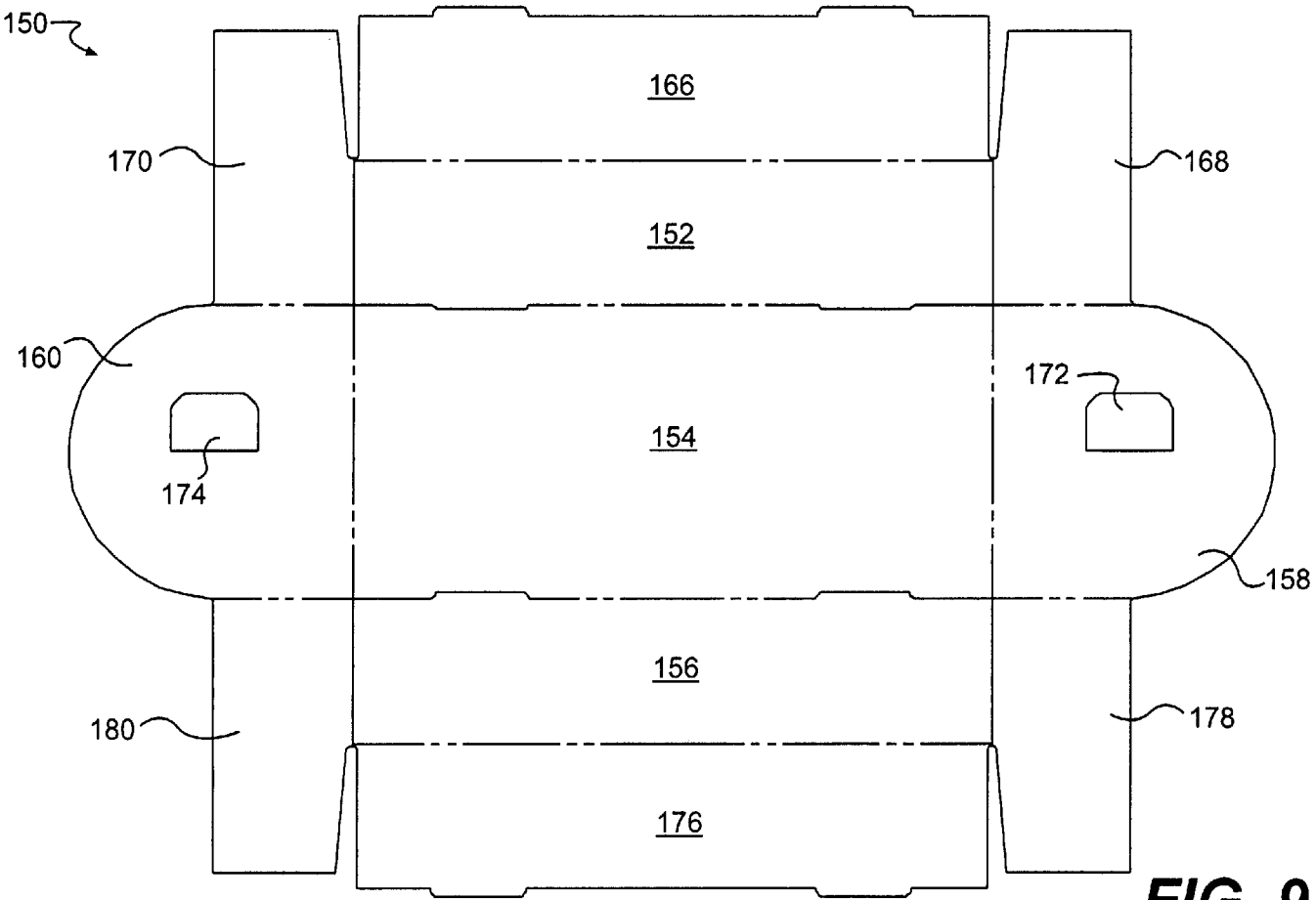
FIG. 9 is a plan view of one embodiment of a blank that may be used to construct the dispenser illustrated in FIG. 8.

The dispenser 112 as shown in FIG. 8 may be constructed from a single blank generally 150 as shown in FIG. 9. The blank 150 includes a first side panel 154 connected on each side to opposing side panels 152 and 156. Side panel 152 is connected to a side flap 166, while side panel 156 is connected to a side flap 176. The side panel 154 is also connected to a pair of opposing end panels 158 and 160. End panel 158 is connected to an end flap 168 on one side and to an end flap 178 on an opposing side. Similarly, the end panel 160 is connected to an end flap 170 on one side and to an end flap 180 on an opposing side. Finally, the blank 150 includes a pair of tabs 172 and 174 which are used to hold and rotatably mount a roll of material within the dispenser.

Figure 10A:
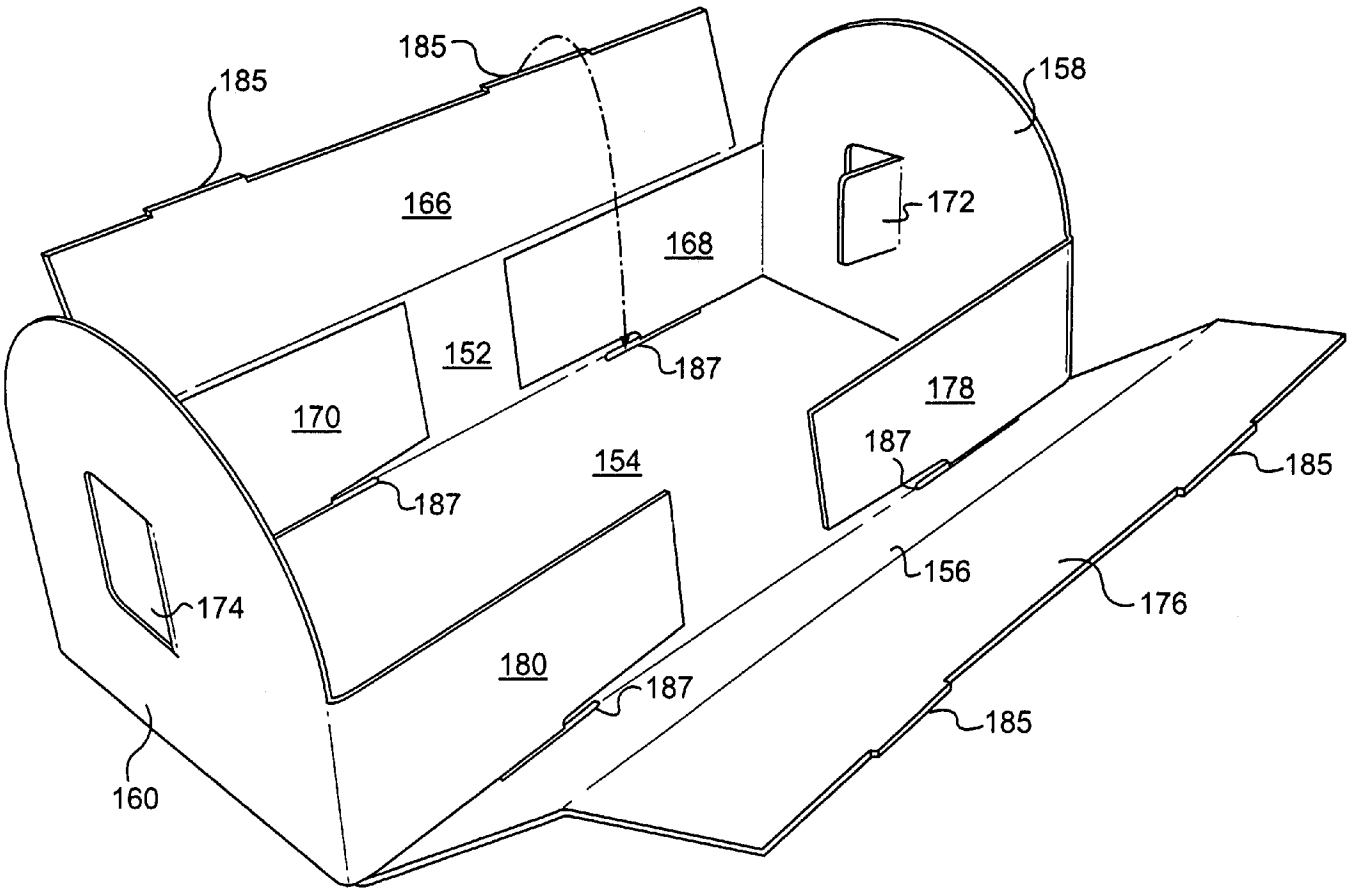
FIG. 10A is a perspective view of the blank illustrated in FIG. 9 shown in a partially folded state.
Figure 10B:
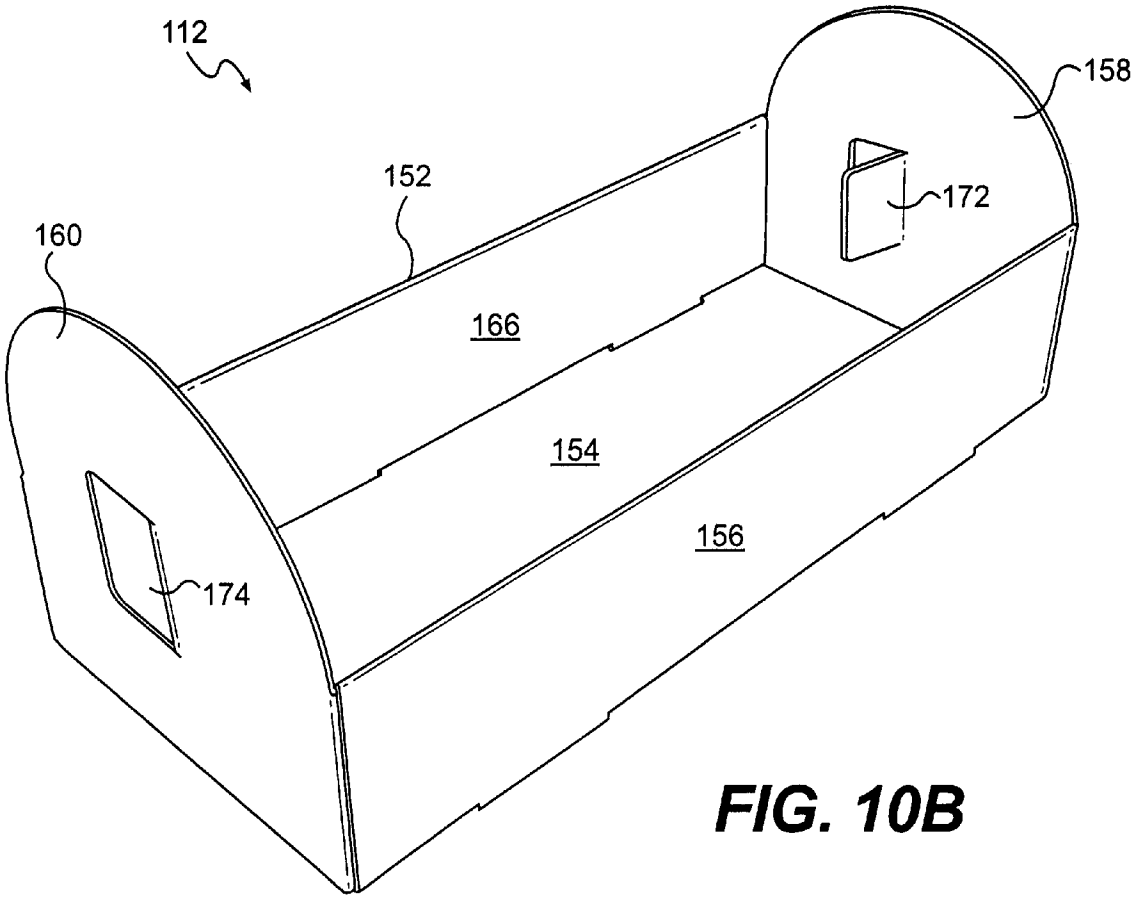
FIG. 10B is a perspective view of a dispenser made from the blank illustrated in FIG. 9.

Referring to FIGS. 10A and 10B, the blank 150 of FIG. 9 is shown being folded into the dispenser 112. As illustrated, the end panels 158 and 160 are folded upwards from the side panel 154. The end flaps 168, 178, 170 and 180 are folded inwardly from the end panels 158 and 160. The side panels 152 and 156 are then folded upwards with respect to the side panel 154. Next, the side flap 176 is folded around the end flaps 178 and 180, while the side flap 166 is folded around the end flaps 170 and 168. As shown, each of the side flaps 166 and 176 include projections 185 that are inserted into corresponding slots 187 after the side flaps are folded around the end flaps. The projections 185 and the corresponding slots 187 lock the side flaps into place without using an adhesive material.

In order to mount a roll of material within the housing formed by the blank 150, tabs 172 and 174 are folded towards the interior of the dispenser. The tabs 172 and 174 are configured to be inserted into a central region such as a hollow center or core of a roll of material for rotatably mounting the roll of material within the dispenser 112.

In the embodiments of the dispenser shown in FIGS. 1A, 1B, 2, 5, and 8, each of the end panels completely surround each end of the roll of material 114. In particular, each end panel includes a bottom rectangular section and a top arcuate-shaped section. The arcuate-shaped section generally has a radius that matches the radius of the roll of material. In this manner, the top portion of the dispenser matches the shape of the roll of material 114.

Figure 11:
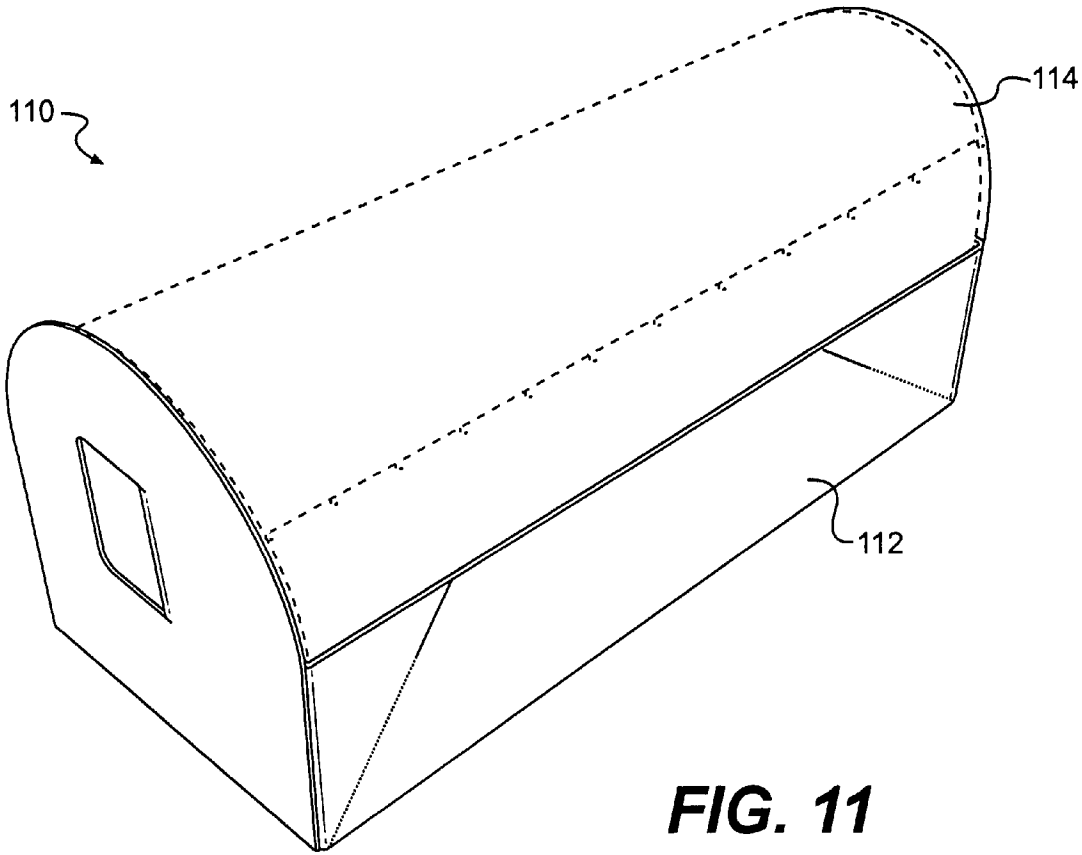
FIG. 11 is still another embodiment of a dispensing and display carton in combination with a rolled product made in accordance with the present invention.
Figure 12:
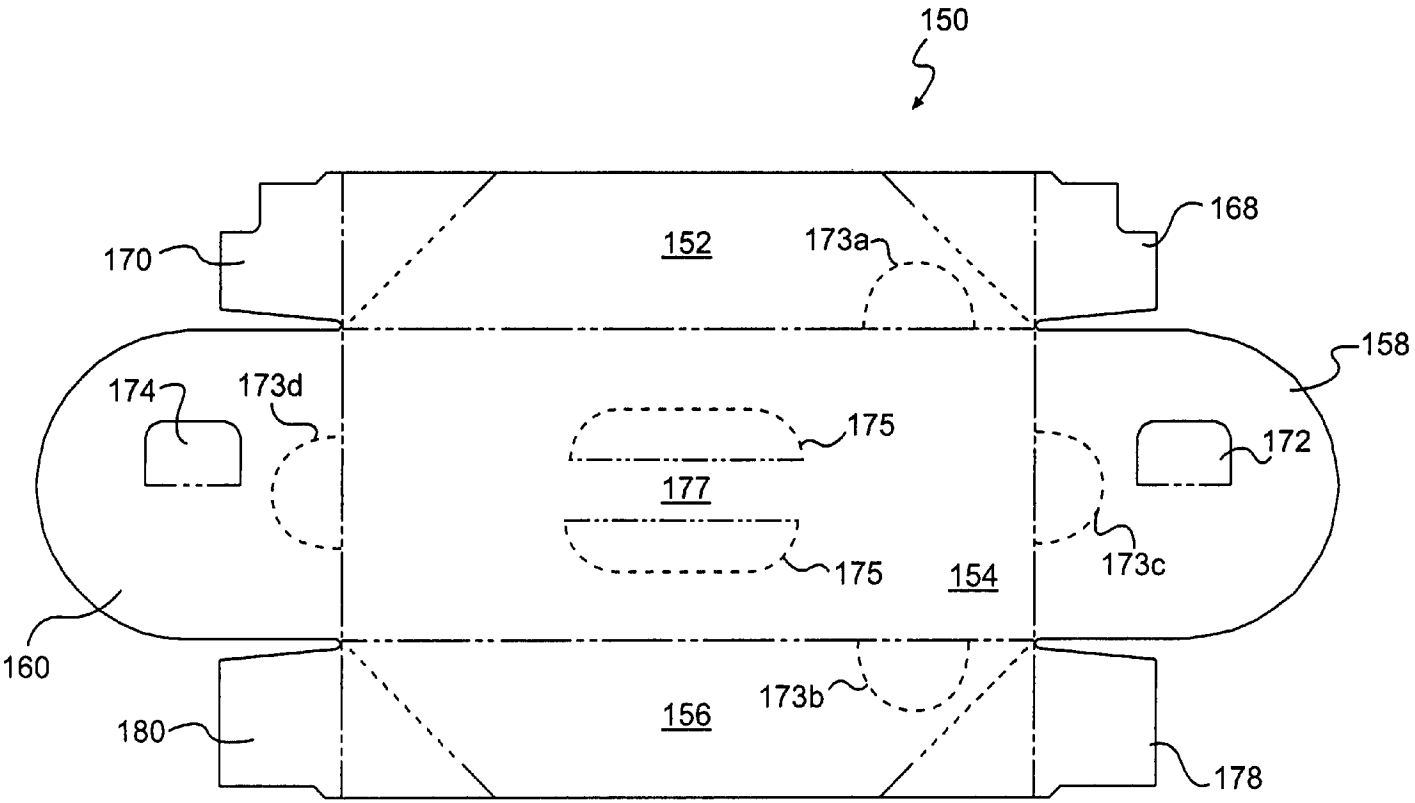
FIG. 12 is a plan view of one embodiment of a blank that may be used to construct the dispenser illustrated in FIG. 11.
Figure 13A:
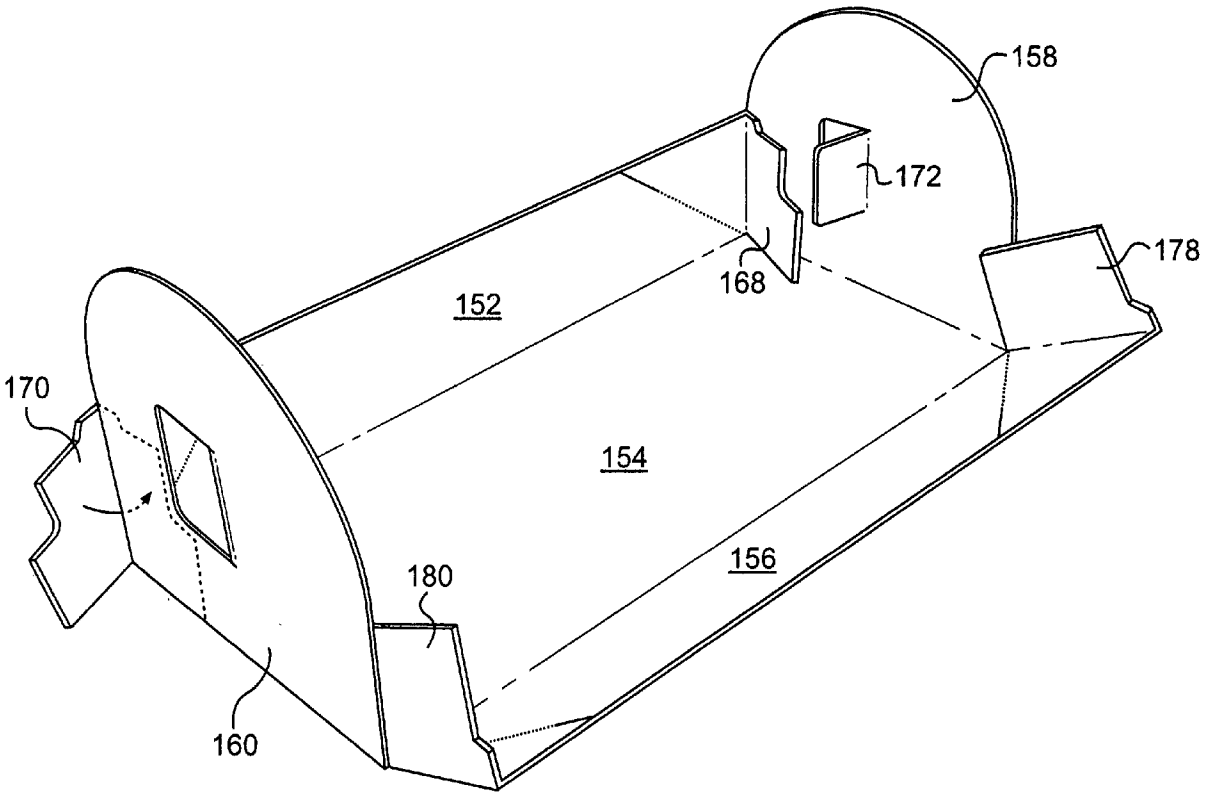
FIG. 13A is a perspective view of the blank illustrated in FIG. 12 shown in a partially folded state.
Figure 13B:
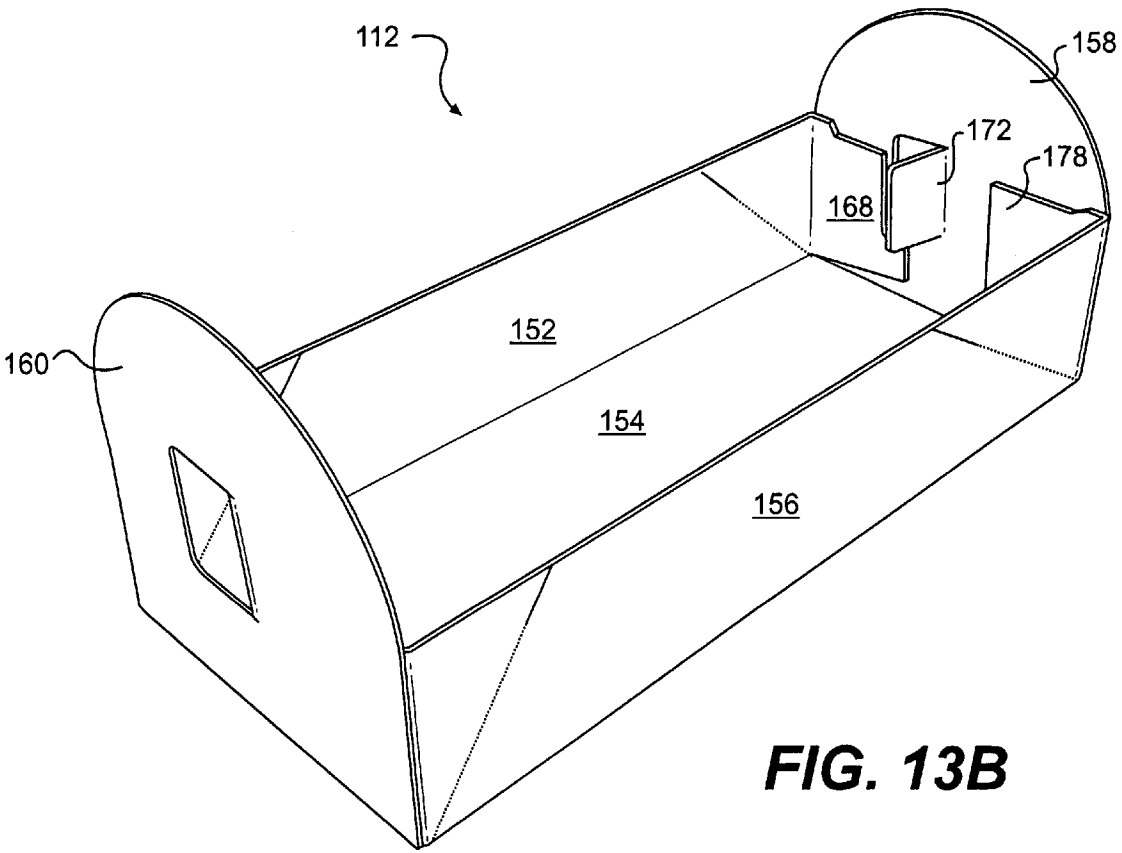
FIG. 13B is a perspective view of a dispenser made from the blank illustrated in FIG. 12.

Referring to FIG. 11, still another embodiment of a carton and roll of material combination generally 110 is shown. The carton and rolled product combination 110 includes a roll of material 114 and a dispenser 112. Construction of the dispenser 112 is illustrated in FIGS. 12, 13A and 13B. Like reference numerals have been used with respect to FIGS. 8, 9, 10A and 10B in order to represent similar elements. As shown, for instance, the dispenser 112 illustrated in FIG. 11 is similar to the shape of the dispenser illustrated in FIG. 8.

Referring to FIGS. 12, 13A and 13B, a blank generally 150 is shown being folded in order to construct the dispenser 112. The blank 150 is similar to the blank shown in FIG. 9 but does not include side flaps. Instead, the blank includes side panels 152, 154 and 156 and end panels 158 and 160. The blank 150 further includes end flaps 168 and 170 which are connected to the side panel 152 and end flaps 178 and 180 which are connected to the side panel 156. Thus, in comparison to the blank shown in FIG. 9, the end flaps 168, 170, 178 and 180 are connected to the side panels 152 and 156 instead of the end panels 158 and 160.

In order to construct the dispenser 112 from the blank 150 as shown in FIG. 12, referring to FIGS. 13A and 13B, the side panels 152 and 156 are folded in an upwards relationship to the side panel 154. The end flaps 168, 170, 178 and 180 are folded inwardly and then are attached to the end panels 158 and 160. The end flaps may be attached to the end panels using, for instance, an adhesive or any other suitable attachment structure. The tabs 172 and 174 are then folded towards the interior of the housing in order to hold a roll of material.

In certain embodiments of the present invention, the dispenser 112 may include gripping elements for grasping the dispenser. The gripping elements, for instance, may be used to assist in dispensing and tearing off a single sheet from the roll of material. In other embodiments, however, the gripping elements may be used to carry and transport the dispenser 112 when desired. For example, referring to FIG. 12, in this embodiment, the dispenser 112 may include perforation lines 173*a, b, c, d* on the panels 152, 156, 158, 160. As shown, the perforation lines 173 are in the shape of a horseshoe although any other suitable shape may be used. In order to form a gripping element, a user may punch their fingers against, for instance, the side panel 152 in order to cause the perforation lines 173*a* to tear or break open. Once the perforation lines 173*a* are broken open, a hole or opening is formed in the side panel 152 through which a user may insert a finger, for instance, in order to grasp and hold the dispenser 112. In the illustrated embodiment, a set of perforation lines 173*b* can be located on side panel 156 opposite perforation lines 173*a* on side panel 152. In this particular embodiment, a user can also open perforation lines 173*b* to form a second hole on side panel 156 in order to securely grasp and hold the dispenser 112 at two openings.

As shown in FIG. 12, similar gripping elements may also be formed into the end panels 158, 160. Of course, the number and location of gripping elements on any panel can be varied in different embodiments of the invention. For example, in other embodiments, it may be advantageous to include two or more perforation lines 173 on a single side panel 152, 165 and/or end panel 158, 160. Similarly, any set of perforation lines 173 can be conveniently located on any area of a side panel 152, 156 and/or end panel 158, 160.

Instead of or in addition to the perforation lines 173, as shown in FIG. 12, the dispenser 112 may also include perforation lines 175 formed into the side panel 154. As shown, the perforation lines 175 are positioned around an elongated section 177. In this manner, a user may punch through the perforation lines 175 in order to form a handle 177 for carrying and transporting the dispenser 112.

Referring to FIGS. 14, 15, 16A and 16B, another embodiment of a dispensing and display carton and rolled product combination generally 210 is shown. As illustrated particularly in FIG. 14, the dispensing carton and rolled product combination includes a roll of material 214 rotatably mounted within a dispenser 212. In this embodiment, the dispenser 212 may be considered to represent one half of a rectangular box and generally has a triangular shape. In this embodiment, approximately 50% of the surface area of the roll of material is exposed for easy access to the rolled product.

Figure 14:
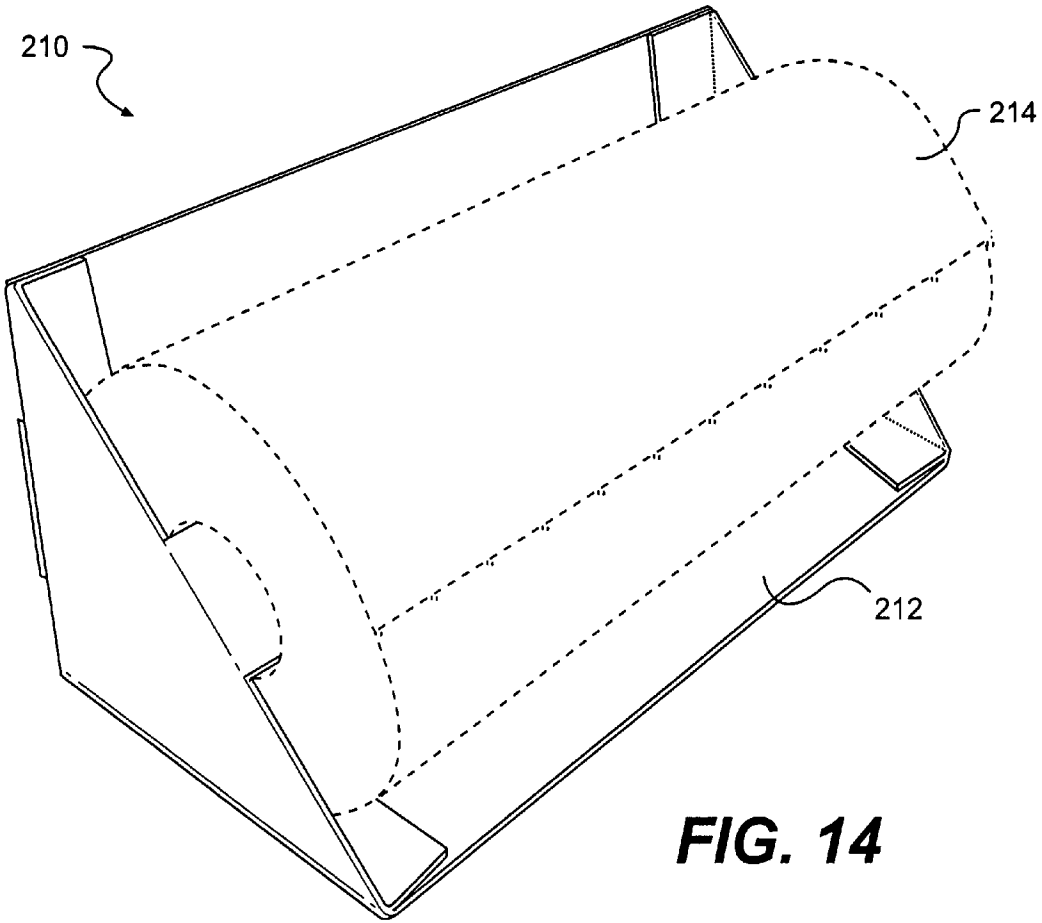
FIG. 14 is another embodiment of a dispensing and display carton in combination with a rolled product made in accordance with the present invention.
Figure 15:
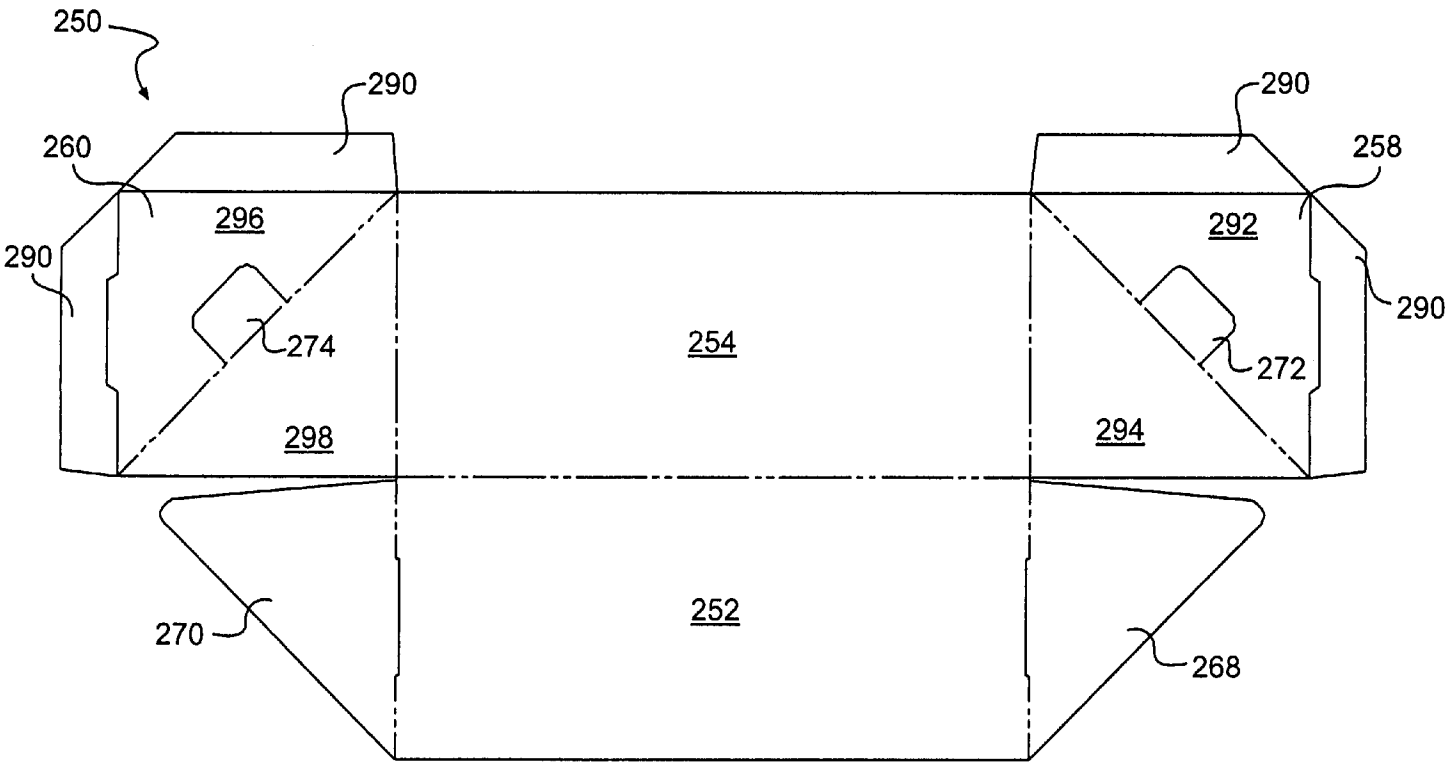
FIG. 15 is a plan view of one embodiment of a blank that may be used to construct the dispenser illustrated in FIG. 14.

Referring to FIG. 15, a blank generally 250 that may be used to construct the dispenser 212 shown in FIG. 14 is illustrated. The blank 250 includes a first side panel 252 and a second side panel 254. A pair of end flaps 268 and 270 are connected at opposite sides to the side panel 252.

The blank 250 further includes a first end panel 258 and a second end panel 260 which are both connected to the side panel 254. Each end panel 258 and 260 includes a pair of flanges 290. The end panel 258 is also divided into a first section 292 and into a second section 294 by a diagonal fold line. Similarly, the end panel 260 is divided into a first section 296 and into a second section 298 by a diagonal fold line. Each end panel is connected to a tab 272 and 274.

Figure 16A:
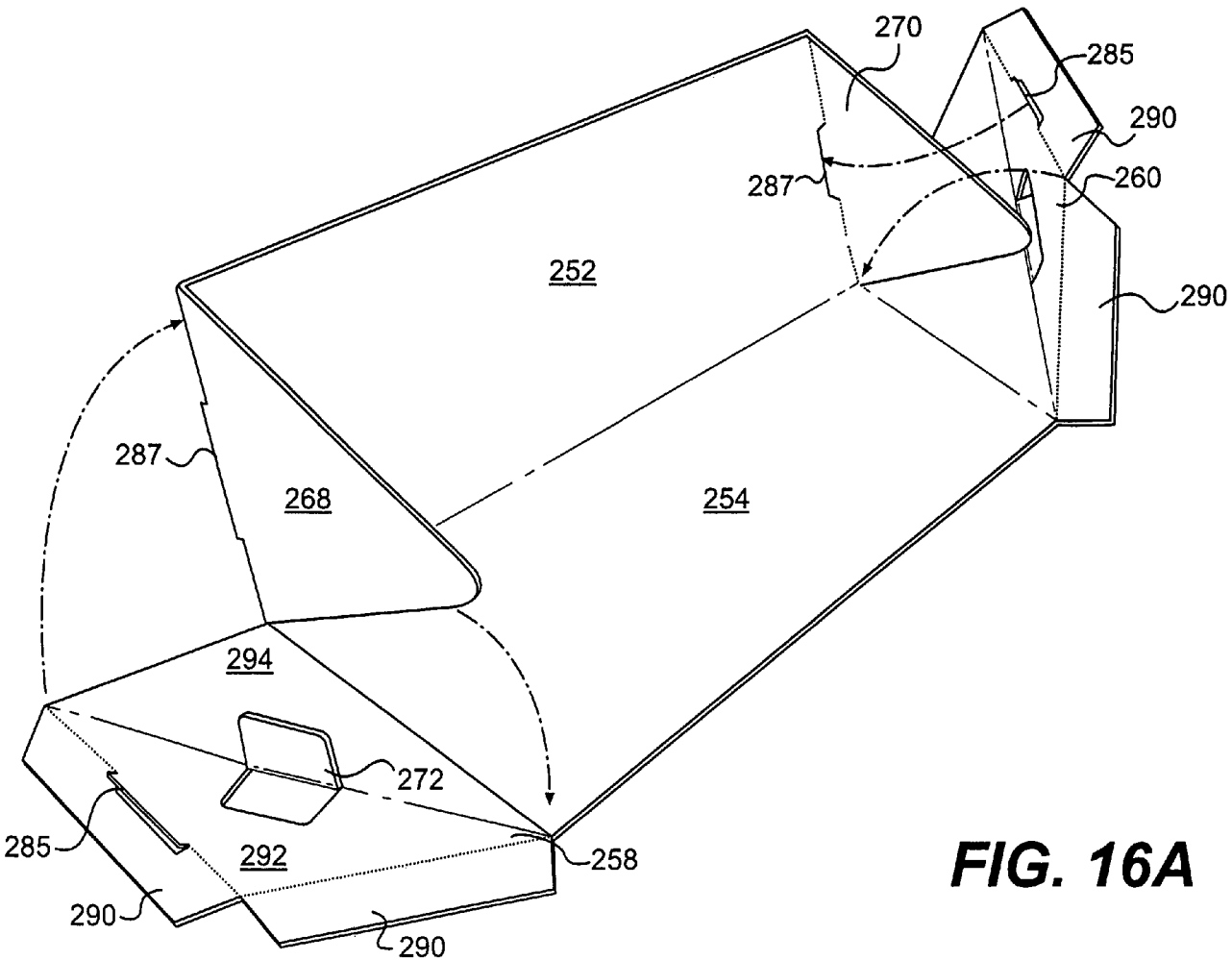
FIG. 16A is a perspective view of the blank illustrated in FIG. 15 shown in a partially folded state.
Figure 16B:
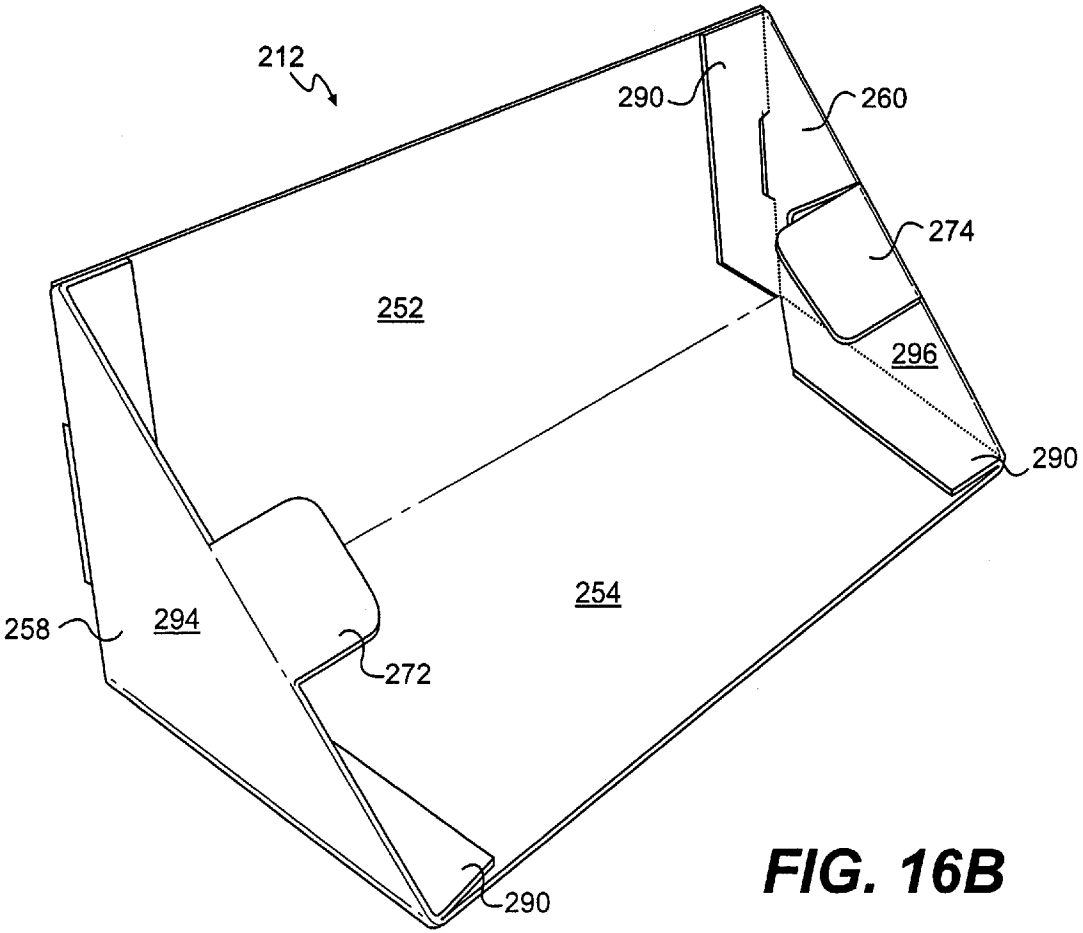
FIG. 16B is a perspective view of a dispenser made from the blank illustrated in FIG. 15.

The blank 250 is shown in a partially folded state in FIG. 16A and into a completely folded state so as to form the dispenser 212 in FIG. 16B. As illustrated in FIG. 16A, the side panel 252 is folded so as to form approximately a 90° angle with the side panel 254. The angle, for instance, may be from about 70° to about 110°, such as from about 85° to about 95°. The end flaps 268 and 270 are also folded inwardly.

Next, the end panels 258 and 260 are folded upwards in relation to the side panel 254. The first section 292 of the end panel 258 is then folded around the end flap 268. Similarly, the first section 296 of the end panel 260 is folded around the end flap 270. The flanges 290 as shown in FIG. 16B are folded to lay adjacent to the side panels 252 and 254. Next, the tabs 272 and 274 are folded outwardly. The tabs 272 and 274 are for rotatably mounting a roll of material within the dispenser 212.

As illustrated in FIG. 16A, when the flanges 290 are folded, each of the first sections 292 and 296 define a projection 285. When the first sections 292 and 296 are folded respectively around the end panels 258 and 260, the projections 285 are inserted into corresponding slots 287, thus locking the end panels into place.

As shown in FIG. 16B, the end panels 258 and 260, in this embodiment, have a triangular shape. Thus, the end panels 258 and 260 only cover approximately 50% of the surface area of each corresponding end of a roll of material 214 as shown in FIG. 14.

Figure 17:
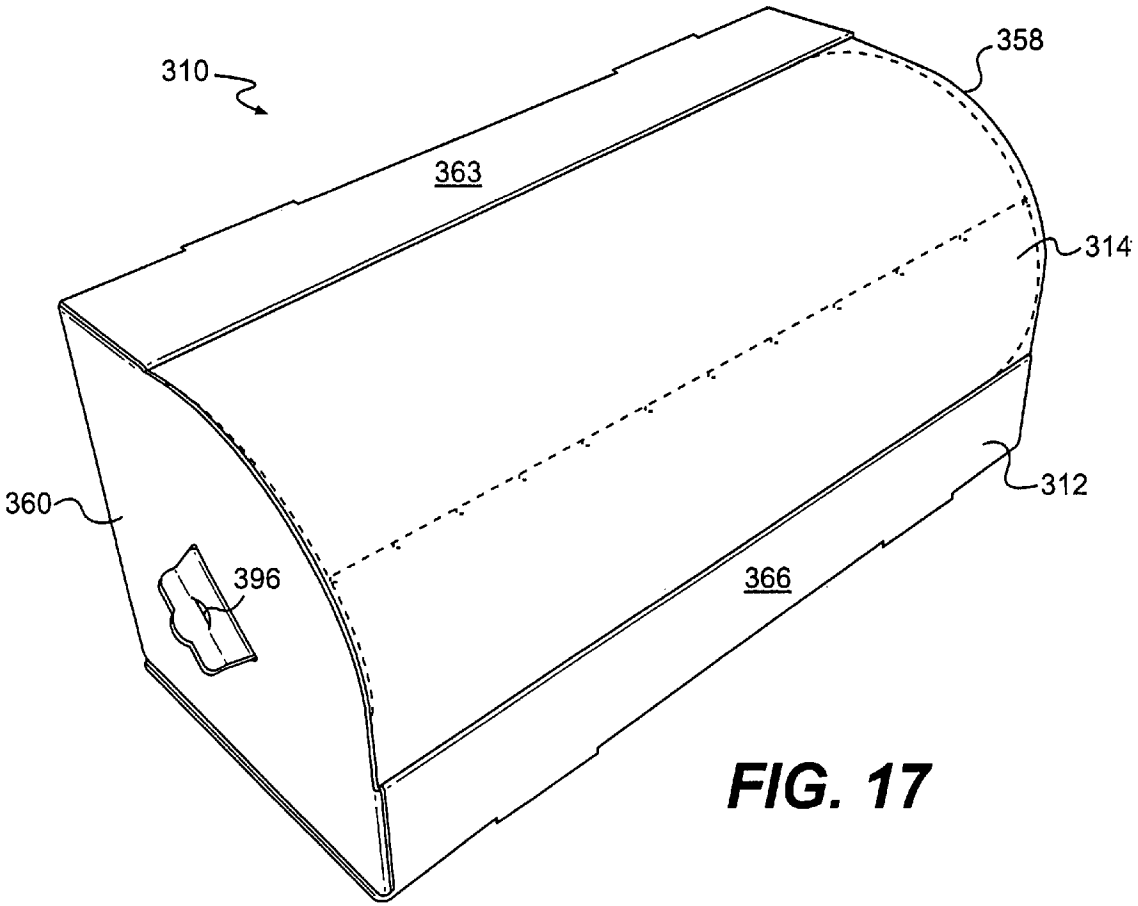
FIG. 17 is a perspective view of another embodiment of a dispensing and display carton in combination with a rolled product made in accordance with the present invention.

Referring to FIGS. 17 through 19D, still another embodiment of a dispensing carton and rolled product combination generally 310 is illustrated. Referring to FIG. 17, the dispensing carton and rolled product combination 310 includes a roll of material 314 rotatably mounted within a dispenser 312. In this embodiment, the dispenser 312 includes a generally triangular shape that includes a pair of additional side panels 363 and 366 that serve to further enclose the roll of material 314 while still leaving an open access area for unraveling the roll of material 314.

In the embodiment illustrated in FIG. 17, the dispenser 312 includes a pair of opposing end panels 358 and 360 that generally cover the entire surface area of a corresponding end of the roll of material 314. Each end panel 358 and 360 includes three corners and an arcuate-shaped edge. The arcuate-shaped edge generally has a radius that matches the radius of the roll of material 314.

Figure 18:
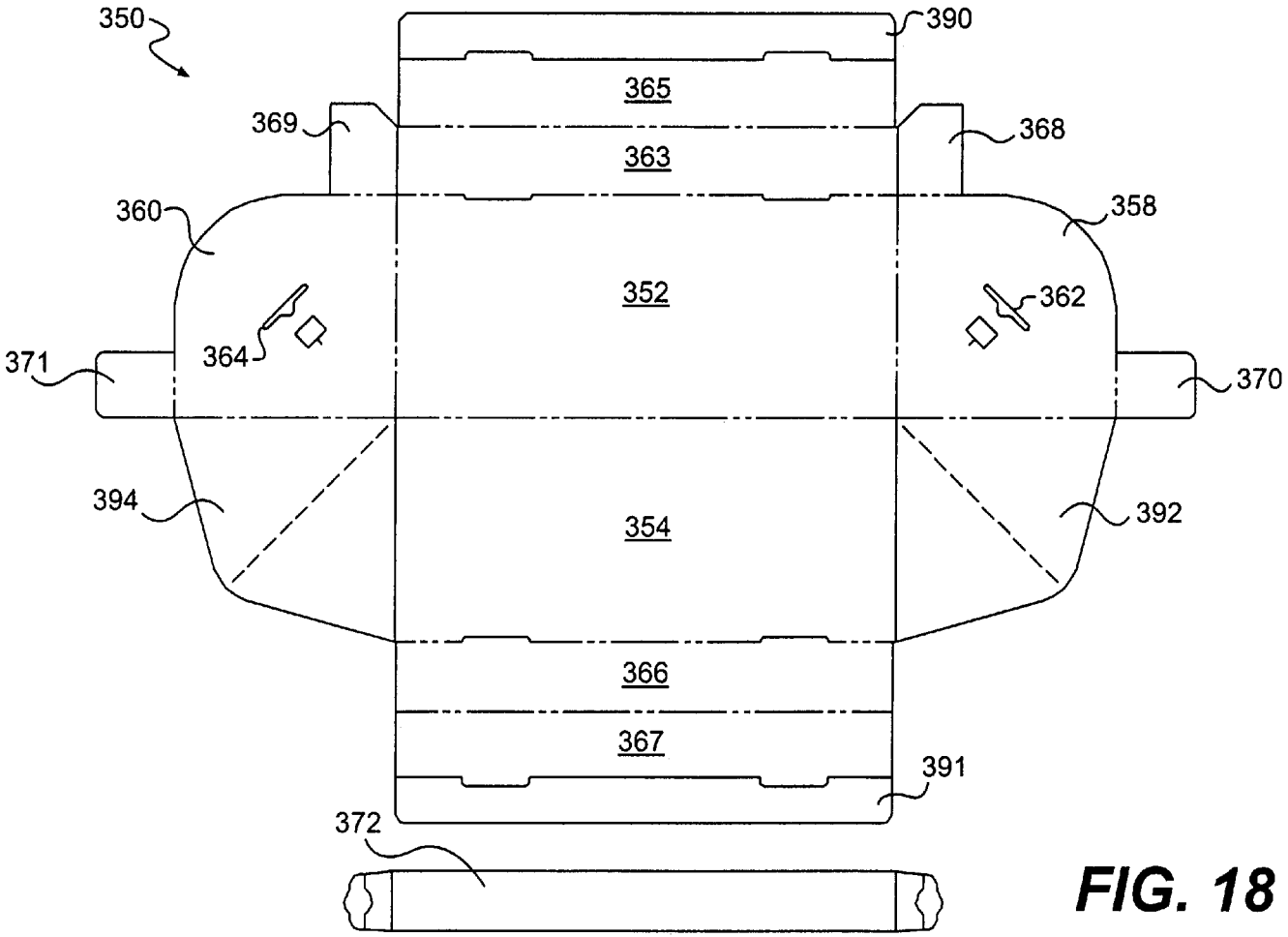
FIG. 18 is a plan view of one embodiment of a blank that may be used to construct the dispenser illustrated in FIG. 17.

Referring to FIG. 18, a blank 350 is shown which may be folded into the dispenser 312 illustrated in FIG. 17. The blank 350 includes side panels 352, 354, 363 and 366. Side panel 363 is connected to a side flap 368 which, in turn, is connected to a flange 390. Similarly, side panel 366 is connected to a side flap 367 which, in turn, is connected to a flange 391.

A first end panel 358 is connected to one end of the side panel 352, while a second end panel 360 is connected to the opposite end of the side panel 352. The end panel 358 is connected to a pair of end flaps 368 and 370, while the end panel 360 is connected to a pair of end flaps 369 and 371. End panel 358 also defines a slot 362, while end panel 360 defines a slot 364.

Located in between the end panel 358 and the side panel 354 is a triangular section 392. Similarly, connected to and positioned in between the end panel 360 and the side panel 354 is a triangular section 394. Each of the triangular sections 392 and 394 define a diagonal fold line.

Finally, the blank 350 includes a spindle 372. The spindle 372 may be initially connected to the blank 350 and then later separated for use in constructing the dispenser 312.

Figure 19A:
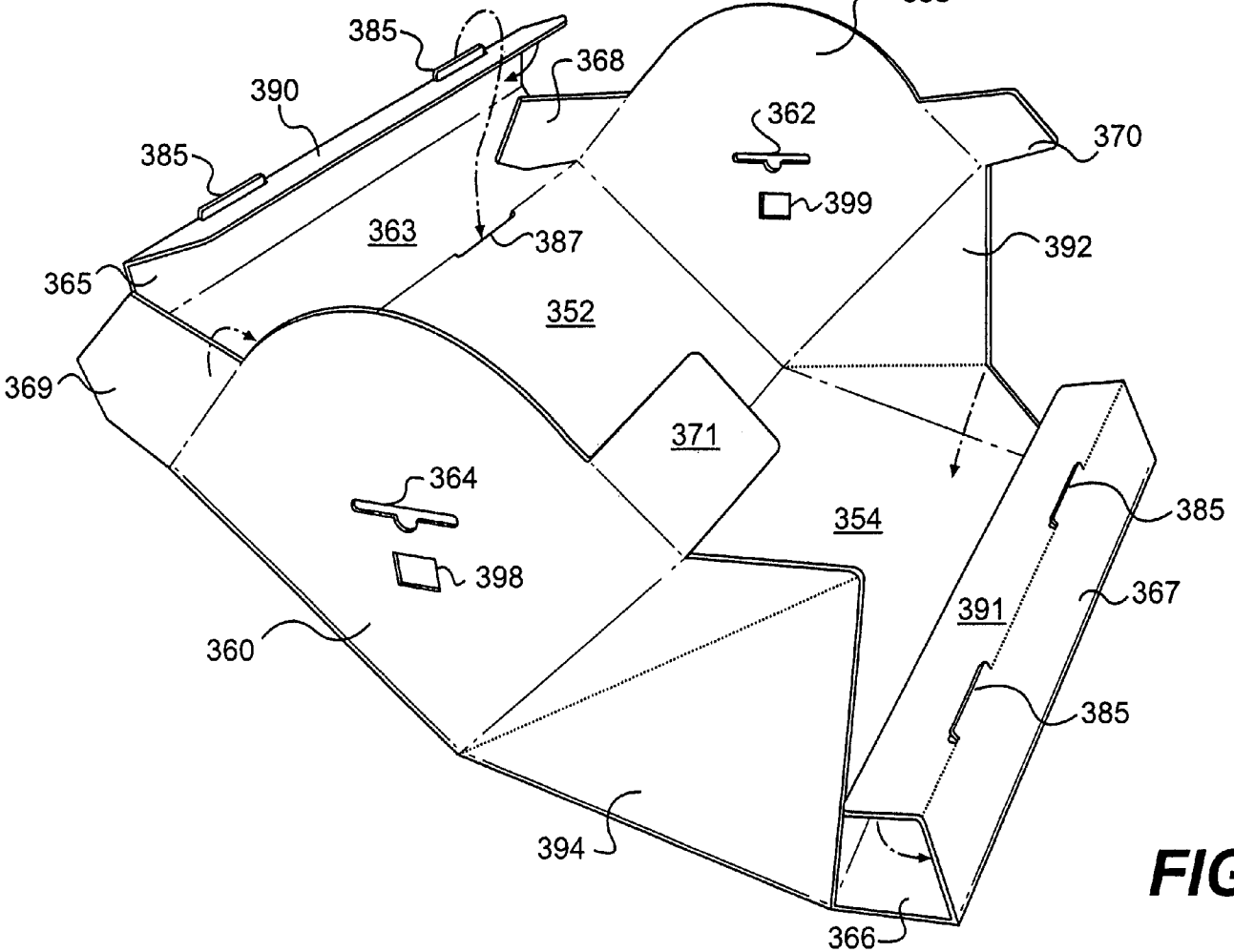
FIG. 19A is a perspective view of the blank illustrated in FIG. 18 shown in a partially folded state.

Referring to FIG. 19A, the blank 350 is shown in a partially folded state. As shown, each end panel 358 and 360 is folded upwards in relation to side panel 352. The end flaps 368, 369, 370 and 371 are also folded towards the interior of the dispenser.

Side panel 363 is folded upwards at an angle to the side panel 352. Flange 390 is folded onto the side flap 365 exposing a pair of projections 385. The side flap 365 is then folded over the end flaps 368 and 369 and locked into position by inserting the projections 385 into corresponding slots 387.

On the opposite side of the side panel 352, the triangular sections 392 and 394 are folded inwardly along the diagonal fold line. Once folded, the triangular sections rest against the side panel 354. The flange 391 is folded against the side flap 367 exposing projections 385. The flange 391 is then folded over the end flaps 370 and 371 and locked into position by inserting the projections into slots leaving the side panel 366 in an upright and angled position relative to the side panel 354.

Figure 19B:
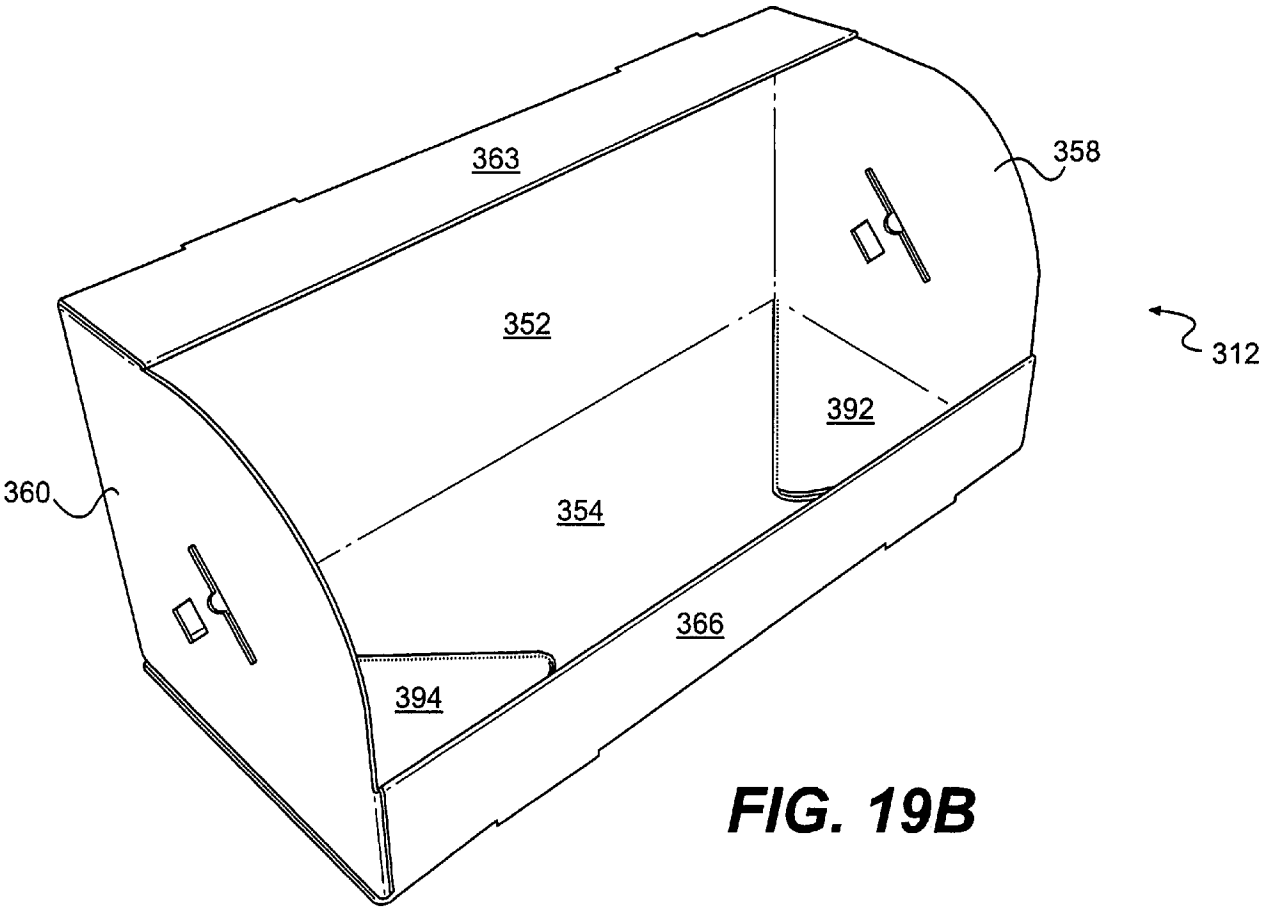
FIG. 19B is a perspective view of a dispenser made from the blank illustrated in FIG. 18.

The assembled dispenser 312 is shown in FIG. 19B. As shown, the dispenser 312 includes the side panels 352, 354, 363 and 366. The triangular sections 392 and 394 are shown adjacent the side panel 354. The dispenser 312 as shown in FIG. 19 may be constructed without the use of any adhesive material.

In order to mount the roll of material 314 into the dispenser 312, as shown in FIG. 19C, the roll of material is first inserted into the dispenser. The roll of material 314 includes a hollow core. The ends of the hollow core are aligned with the slots 362 and 364 appearing on the end panels 358 and 360.

Figure 19D:
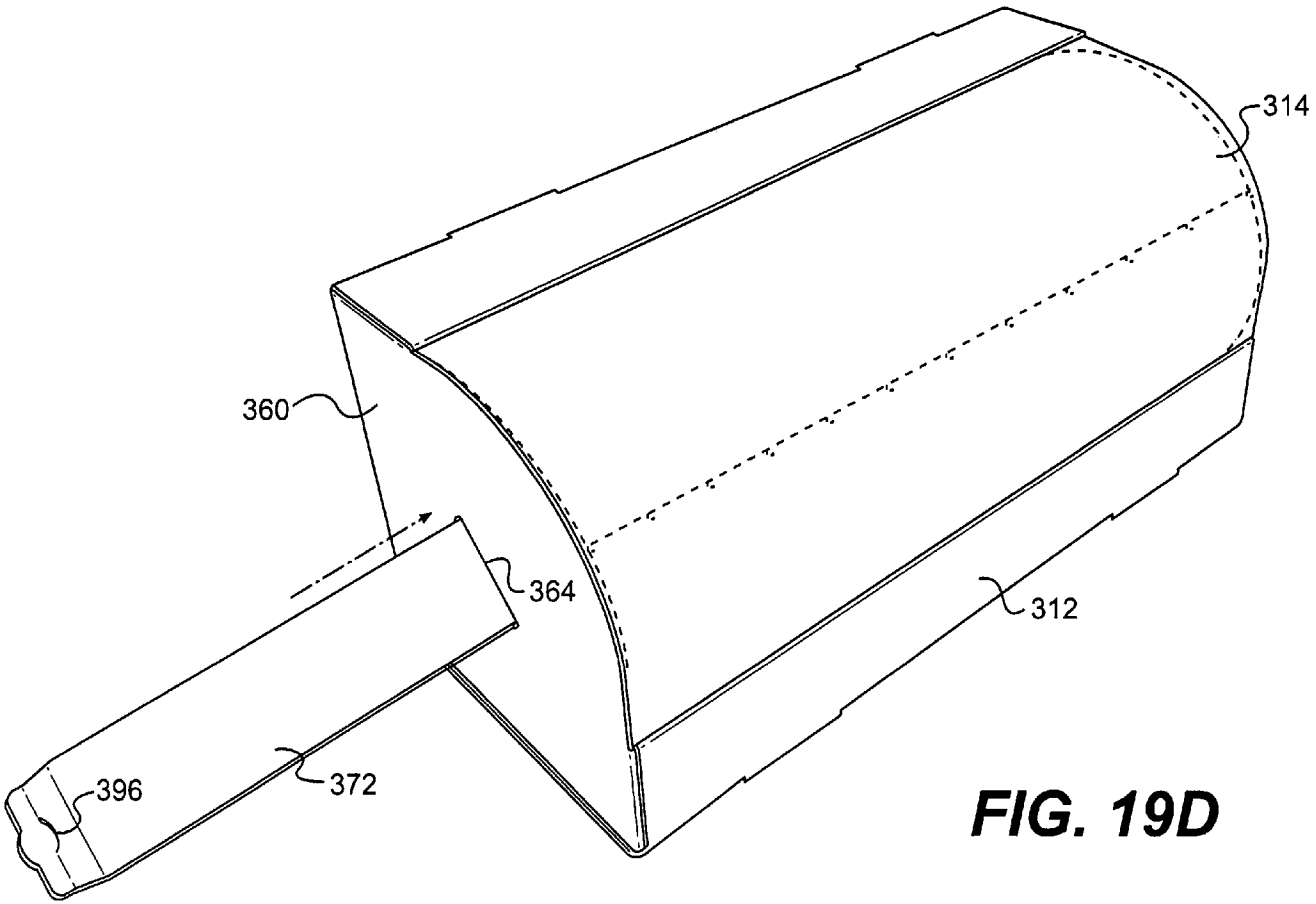
FIG. 19D is a perspective view of a dispenser made from the blank illustrated in FIG. 18 showing a roll of material being mounted on a spindle in accordance with the present invention.

Referring to FIG. 19D, the spindle 372 is then inserted into the slot 364. The spindle is further inserted into the hollow core of the roll of material 314 and then out through the slot 362 of the end panel 358.

Once the spindle 372 is inserted into the slots 364 and 362, the spindle can be secured in place using any suitable attachment structure. In the embodiment shown in FIG. 17, for instance, the spindle 372 includes a locking element 396 that is folded and placed into engagement with a cutout portion 398 appearing on the end panel 360 as shown in FIG. 19A. Similarly, an opposing locking element 396 may also be inserted into a cutout portion 399 appearing on the end panel 358.

As shown above, the dispenser of the present invention may be constructed in various ways and may take on various forms.

The present invention may be better understood with reference to the following example.

EXAMPLE

The dispensers as illustrated in FIGS. 2, 5, 11, 14 and 17 were constructed and sized to hold a roll of paper towels. After being constructed, the different embodiments were tested to determine how much force was needed in order to remove the entire roll of paper towels from the dispenser after being mounted within the dispenser. The purpose of the following tests were to ensure that the roll of paper towels would remain mounted in the dispenser even if a free end of the roll of paper towels was pulled upon and jerked in order to remove a single sheet.

The towel dispenser strength test measures peak load and the energy to peak. The peak load is the minimum force needed to break the paper towel roll away from the dispenser. The energy to peak is the total energy required to break the paper towel roll away from the dispenser Equipment/Materials
Tensile Frame Model: MTS Sintech 1/G
Software: TestWorks 4.08B
Load Cell: 100N
Crosshead Speed: 80 in"/min.
Break Sensitivity: 95%
Grips: Instron (200 lb max)
Grip Faces: Instron 1"×10" rubber faced
Base Plate Dimension: 11"×12"
Tape Width/Make—3¼"/3M Electrical Tape 3224-1
Velcro Loop: Velcro Brand Loop 1000 2" Black 330 PSA 0172
Velcro Hook: Velcro Brand Hook 88 2" Black 330 PSA 0172
Specimen/Materials Preparation Two strips of the 3M electrical tape approximately 24" long were cut. Each strip was folded onto itself (adhesive side to adhesive side) until two pull straps approximately 12" long were obtained.

Two strips of the self adhering Velcro hook material was adhered over the entire length of the base plate (approx. 2"×12" on the tensile frame). The strips were separated approximately 1" along the entire length so that they were adhered to the base plate.

For each dispenser two 2"×11" pieces of self adhering Velcro loop strips were adhered to each of the outside edges of the dispenser bases.

Test Procedure

The towel dispenser was placed on the base plate over the two hook strips, making sure the dispenser was centered under the grip faces in both length and width directions. The base of the towel dispenser was pressed down firmly to ensure that it was secured.

Two 3¼" wide straps were placed in the towel dispenser around the roll of paper towels approximately 1½" in from the inside edge of each side of the dispenser.

Both of the straps were put together so that the top edges are even. The straps were then inserted into the grip face. Both straps were checked to make sure they were even to ensure a uniform pull of the paper towel roll.

The test was run and stopped when the towel was completely pulled out of the dispenser.

The average results of the test runs were obtained and reported below:

| | Embodiment | | | | |
|---|---|---|---|---|---|
| | FIG. 14 | FIG. 11 | FIG. 2 | FIG. 17 | FIG. 5 |
| Peak load (kg-f) | 0.594 | 4.385 | 5.895 | 6.3073 | 6.764 |
| Energy to Peak (kg-mm) | 12.073 | 49.061 | 134.026 | 97.595 | 169.144 |

As shown above, except for the embodiment illustrated in FIG. 14, it took over 4 kg-f to remove a roll of paper towels from the dispensers. The energy to peak was greater than 12 kg-mm for all of the samples, and greater than 49 kg-mm for all but one of the embodiments tested.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispensing and display carton in combination with a rolled product comprising:

a sheet material wound about an axis into a roll of material, the roll of material including an outer cylindrical surface; and a dispenser for dispensing the roll of material, the dispenser comprising a housing having a first end and a second end, the dispenser further comprising a roll holding device that comprises a pair of opposing tabs, the roll of material being placed in the dispenser such that the axis of the roll substantially extends from the first end to the second end, the roll of material being configured to rotate and unwind while in the dispenser for dispensing the sheet material, the housing partially encircling the outer cylindrical surface of the roll of material so as to cover from about 40% to about 70% of the outer cylindrical surface, the housing and the roll holding device being integral such that both are constructed from a single blank, the outer cylindrical surface being substantially exposed through only one access opening, the roll of material extending out from the one access opening.

2. A dispensing and display carton in combination with a rolled product as defined in claim 1, wherein the dispenser is made from a material comprising cellulosic fibers.

3. A dispensing and display carton in combination with a rolled product as defined in claim 1, wherein the housing partially encircles the outer cylindrical surface of the rolled material so as to cover from about 45% to about 67% of the outer surface.

4. A dispensing and display carton in combination with a rolled product as defined in claim 1, wherein the housing includes at least a first side panel connected to a second side panel at an angle of from about 70° to about 110°, the first and second side panels extending from the first end to the second end of the housing.

5. A dispensing and display carton in combination with a rolled product as defined in claim 4, wherein at least one of the ends of the housing is configured to support the roll of material in an upright and vertical position and wherein at least one of the side panels is configured to support the roll of material in a horizontal position.

6. A dispensing and display carton in combination with a rolled product as defined in claim 1, wherein the sheet material comprises a tissue product having a basis weight of from about 20 gsm to about 120 gsm.

7. A dispensing and display carton in combination with a rolled product as defined in claim 1, wherein the sheet material comprises an airlaid web, a coform web, a hydroentangled web, a meltblown web, a spunbond web, or a laminate thereof.

8. A dispensing and display carton in combination with a rolled product as defined in claim 1, wherein the sheet material includes at least one design element that coordinates with a design element on the dispenser, the design element comprising a pattern, a graphic subject, a texture, a color or a graphic style.

9. A dispensing and display carton in combination with a rolled product as defined in claim 1, wherein the sheet material includes at least one non-white color that is within three steps on the Munsell color scale in terms of any one of hue, value or chroma of a color appearing on the dispenser.

10. A dispensing and display carton in combination with a rolled product as defined in claim 9, wherein the non-white color appearing on the sheet material is within three steps of the color appearing on the dispenser in terms of hue, is within three steps of the color appearing on the dispenser in terms of value, and is within three steps of the color appearing on the dispenser in terms of chroma based on the Munsell color scale.

11. A dispensing and display carton in combination with a rolled product as defined in claim 1, wherein the roll of material includes a central region, the roll holding device is inserted into the central region of the roll of material for holding the roll of material in a manner that allows the roll of material to rotate in the dispenser.

12. A dispensing and display carton in combination with a rolled product as defined in claim 11, wherein the roll holding device comprises a spindle that extends from the first end to the second end of the housing.

13. A dispensing and display carton in combination with a rolled product as defined in claim 1, each end of the housing has a triangular shape.

14. A dispensing and display carton in combination with a rolled product as defined in claim 1, wherein the first end and the second end of the housing each have a rectangular section and an arcuate-shaped section, the arcuate-shaped section having a radius that is configured to match the radius of the roll of material.

15. A dispensing and display carton in combination with a rolled product comprising:

a roll of paper towels comprising a tissue sheet wound about an axis, the tissue sheet comprising papermaking fibers, the roll including an outer cylindrical surface; and a dispenser for dispensing the roll of paper towels, the dispenser comprising a housing having a first end and a second end, the dispenser further comprising a roll holding device that comprises a pair of opposing tabs, the roll of paper towels being placed in the dispenser such that the axis of the roll substantially extends from the first end to the second end, the roll of paper towels being configured to rotate and unwind while in the dispenser for dispensing the tissue sheet, the housing partially encircling the outer cylindrical surface of the roll of paper towels, the housing and the roll holding device being integral such that both are constructed from a single blank, the outer cylindrical surface being substantially exposed through only one access opening, the roll of material extending out from the one access opening, and wherein at least one of the ends of the housing is configured to support the roll of material in an upright and vertical position and wherein the housing includes a side surface that is configured to support the roll of material in a horizontal position.

16. A dispensing and display carton in combination with a rolled product as defined in claim 15, wherein the housing partially encircles the outer cylindrical surface of a roll of paper towels so as to cover from about 40% to about 70% of the outer surface.

17. A dispensing and display carton in combination with a rolled product as defined in claim 15, wherein the dispenser is made from a material comprising cellulose fibers.

18. A dispensing and display carton in combination with a rolled product as defined in claim 15, wherein the housing includes at least a first side panel connected to a second side panel at an angle of from about 70° to about 110°, the first and second side panels extending from the first end to the second end of the housing.

19. A dispensing and display carton in combination with a rolled product as defined in claim 15, wherein the tissue sheet includes at least one design element that coordinates with a design element on the dispenser, the design element comprising a pattern, a graphic subject, a texture, a color, or a graphic style.

20. A dispensing and display carton in combination with a rolled product as defined in claim 15, wherein the tissue sheet includes at least one non-white color that is within three steps on the Munsell color scale in terms of any one of hue, value or chroma of a color appearing on the dispenser.

21. A dispensing and display carton in combination with a rolled product as defined in claim 15, wherein the roll of material includes an axial central region, the dispenser further comprising a roll holding device that is inserted into at least a portion of the axial central region of the roll of paper towels for holding the roll of paper towels in a manner that allows the roll of paper towels to rotate in the dispenser.

22. A dispensing and display carton in combination with a rolled product as defined in claim 21, wherein the roll holding device holds the roll of paper towels within the housing such that it requires a peak load of at least 4 kilograms of force and an energy to peak of at least 40 kilograms-mm to remove the roll of paper towels from the housing.

23. A dispensing and display carton in combination with a rolled product comprising:

a sheet material wound about an axis into a roll of material, the roll of material including an outer cylindrical surface, the roll of material including at least one design element on the sheet material; and a dispenser for dispensing and displaying the roll of material, the dispenser comprising a roll holding device that comprises a pair of opposing tabs, the dispenser partially surrounding the roll of material, the dispenser being constructed from a single blank, the dispenser including at least one design element that coordinates with the design element on the roll of material, the outer cylindrical surface being substantially exposed through only one access opening.

24. A dispensing and display carton in combination with a rolled product as defined in claim 23, wherein the design element on the sheet material and the design element on the dispenser comprise a texture.

25. A dispensing and display carton in combination with a rolled product as defined in claim 23, wherein the design element on the sheet material and the design element on the dispenser comprise a graphic subject.

26. A dispensing and display carton in combination with a rolled product as defined in claim 23, wherein the design element on the sheet material and the design element on the dispenser comprise a graphic style.

27. A dispensing and display carton in combination with a rolled product as defined in claim 26, wherein the graphic style comprises photograph.

28. A dispensing and display carton in combination with a rolled product as defined in claim 26, wherein the graphic style comprises pointillism.

29. A dispensing and display carton in combination with a rolled product as defined in claim 26, wherein the graphic style comprises watercolor.

30. A dispensing and display carton in combination with a rolled product as defined in claim 26, wherein the graphic style comprises pencil drawings.

31. A dispensing and display carton in combination with a rolled product as defined in claim 23, wherein the design element on the sheet material and the design element on the dispenser comprise a pattern.

32. A dispensing and display carton in combination with a rolled product as defined in claim 23, wherein the design element on the sheet material and the design element on the dispenser comprise a color, and wherein the color on the sheet material is within three steps on the Munsell color scale of a color appearing on the dispenser in terms of any one of hue, value or chroma.

33. A dispensing and display carton in combination with a rolled product as defined in claim 23, wherein the design element on the sheet material and the design element on the dispenser comprise a color, and wherein the color on the sheet material is within two steps on the Munsell color scale of a color appearing on the dispenser in terms of any one of hue, value or chroma.

34. A dispensing and display carton in combination with a rolled product as defined in claim 23, wherein the design element on the sheet material and the design element on the dispenser comprise a color, and wherein the color on the sheet material is within one step on the Munsell color scale of a color appearing on the dispenser in terms of any one of hue, value or chroma.

35. A dispensing and display carton in combination with a rolled product as defined in claim 23, wherein the design element comprises a color and wherein the color on the sheet material is within three steps on the Munsell color scale of a color appearing on the dispenser for at least two of the three Munsell color qualities of hue, value and chrome.

36. A dispensing and display carton in combination with a rolled product as defined in claim 23, wherein the design element comprises color and wherein a color on the sheet material is within three steps on the Munsell color scale of a color appearing on the dispenser in terms of hue, is within three steps on the Munsell color scale of a color appearing on the dispenser in terms of value and is within three steps on the Munsell color scale of a color appearing on the dispenser in terms of chroma.

37. A dispensing and display carton in combination with a rolled product as defined in claim 23, wherein the design element comprises color, and wherein the sheet material includes a color that is at least one step but no greater than three steps away from a color appearing on the dispenser in terms of any one of hue, value or chrome according to the Munsell color scale.

38. A dispensing and display carton in combination with a rolled product as defined in claim 23, wherein the design element comprises a color and wherein a color of a graphic subject on the sheet material coordinates with a background color on the dispenser.

39. A dispensing and display carton in combination with a rolled product as defined in claim 23, wherein at least two design elements on the sheet material coordinate with at least two design elements on the dispenser.

40. A dispensing and display carton in combination with a rolled product as defined in claim 23, wherein at least two design elements on the sheet material coordinate with at least three design elements on the dispenser.

41. A dispensing and display carton in combination with a rolled product as defined in claim 40, wherein at least one of the design elements comprises color.

42. A dispensing and display carton in combination with a rolled product as defined in claim 40, wherein at least one of the design elements comprises color, and wherein at least one of the other design elements comprises a graphic subject, a texture, or a graphic style.

43. A dispensing and display carton in combination with a rolled product as defined in claim 23, wherein an overall design of the design elements appearing on the sheet material coordinates with an overall design of the design elements appearing on the dispenser.

44. A dispensing and display carton in combination with a rolled product as defined in claim 43, wherein the overall design coordination between the sheet material and the dispenser is panel tested.

45. A dispensing and display carton in combination with a rolled product as defined in claim 23, wherein the at least one design element on the sheet material complements the at least one design element on the dispenser.

46. A dispensing and display carton in combination with a rolled product as defined in claim 23, wherein the at least one design element on the sheet material contrasts with the coordinated design element on the dispenser.

47. A dispensing and display carton in combination with a rolled product as defined in claim 23, wherein the at least one design element on the sheet material matches the coordinated design element on the dispenser.

* * * * *